US006326863B1

(12) United States Patent
Kushitani et al.

(10) Patent No.: US 6,326,863 B1
(45) Date of Patent: Dec. 4, 2001

(54) MATCHING CIRCUIT CHIP, FILTER WITH MATCHING CIRCUIT, DUPLEXER AND CELLULAR PHONE

(75) Inventors: Hiroshi Kushitani, Izumisano; Toru Yamada, Katano; Naoki Yuda, Hirakata; Toshio Ishizaki, Kobe; Hideaki Nakakubo, Kyoto; Makoto Fujikawa, Ikoma, all of (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/215,132

(22) Filed: Dec. 18, 1998

(30) Foreign Application Priority Data

Dec. 18, 1997 (JP) ..... 9-349767
Dec. 11, 1998 (JP) ..... 10-352410

(51) Int. Cl.[7] ..... H01P 5/12; H01P 3/08
(52) U.S. Cl. ..... 333/128; 333/126
(58) Field of Search ..... 333/126, 129, 333/132, 134, 128; 455/82, 83; 370/278

(56) References Cited

U.S. PATENT DOCUMENTS 5,191,304 3/1993 Jachowski ..... 333/202
5,202,652 * 4/1993 Tabuchi et al. ..... 333/193
5,602,365 * 2/1997 Bobadilla et al. ..... 174/71 C

FOREIGN PATENT DOCUMENTS 5-218705 8/1993 (JP) .
6-268410 9/1994 (JP) .
6-268411 9/1994 (JP) .

* cited by examiner

*Primary Examiner*—Robert Pascal
*Assistant Examiner*—Kimberly E Glenn
(74) *Attorney, Agent, or Firm*—Smith, Gambrell & Russell, LLP

(57) ABSTRACT

The present matching circuit chip has an integrated shape comprising a first transmission line, a second transmission line and a third transmission line, wherein one end of the first transmission line, one end of the second transmission line and one end of the third transmission line are connected to one another, a first filter connection terminal is connected to the other end of the first transmission line, an antenna terminal is connected to the other end of the second transmission line, and a second filter connection terminal is connected to the other end of the third transmission line, whereby the second transmission line converts the characteristic impedances of the first and third transmission lines so that the impedance matching between the antenna terminal and the first filter connection terminal can be attained, and so that the impedance matching between the antenna terminal and the second filter connection terminal can be attained.

5 Claims, 21 Drawing Sheets

MATCHING CIRCUIT CHIP, FILTER WITH MATCHING CIRCUIT, DUPLEXER AND CELLULAR PHONE

BACKGROUND OF THE INVENTION

1. Field of the Invention

The present invention relates to a matching circuit chip, a filter with a matching circuit and a duplexer mainly used for high-frequency apparatuses such as cellular phones.

2. Description of the Related Art

Conventionally, a duplexer comprises a high-impedance transmission line 2004 connected between a receiving filter 2006 and an antenna terminal 2002, and a high-impedance transmission line 2005 connected between the antenna terminal 2002 and a transmitting filter 2007 as shown in FIG. 21. Each of the transmission lines 2004 and 2005 is used to reverse the phase of the pass band frequency of its mating filter, thereby to obtain a high impedance condition at high frequencies. The transmission line 2004 is set so that the impedance of the receiving filter 2006 becomes open at the pass band frequencies of the transmitting filter 2007, and the transmission line 2005 is set so that the impedance of the transmitting filter 2007 becomes open at the pass band frequencies of the receiving filter 2006. As a result, a signal to be transmitted from the transmitting terminal 2003 to the antenna terminal 2002 is not affected by the receiving filter 2006, and a signal to be transmitted from the antenna terminal 2002 to the receiving terminal 2001 is not affected by the transmitting filter 2007. The circuit is thus used as a duplexer operating at a desired band.

In this kind of conventional duplexer, lines are required to be formed within a substrate having a low dielectric constant so that the transmission lines thereof have a sufficiently high impedance, thereby causing a problem of making the lengths of the lines longer and making the size of the duplexer larger. In addition, in the case when chip components are used instead of the transmission lines to form a matching circuit, problems are also caused; the number of components increases, and a frequency band wherein impedance matching can be attained becomes narrow.

SUMMARY OF THE INVENTION

In order to solve the above-mentioned problems, an object of the present invention is to achieve a matching circuit chip etc. which is simple in configuration and compact in size, and requires less number of components.

The 1st invention of the present invention is a matching circuit chip of an integrated shape comprising a plurality of terminals including a terminal for connection to a transmitting circuit or a receiving circuit, an antenna terminal for connection to an antenna, a first transmission line, a second transmission line and a third transmission line, wherein (1) one end of said first transmission line is connected to one end of said second transmission line and one end of said third transmission line, (2) the other end of said first transmission line is connected to a first terminal among said plural terminals, (3) the other end of said second transmission line is connected to said antenna terminal, and (4) the other end of said third transmission line is connected to a second terminal among said plural terminals.

With this configuration, for example, the characteristic impedances of the first and third transmission lines are converted by the second transmission line, whereby impedance matching can be attained at the antenna terminal.

The 2nd invention of the present invention is a matching circuit chip in accordance with said 1st invention, wherein one end of a fourth transmission line is connected to the connection point of said first transmission line, said second transmission line and said third transmission line, and the other end of said fourth transmission line is grounded.

With this configuration, for example, a load to the second transmission line for performing impedance conversion can be reduced, and impedance matching can be attained in a wide frequency range.

The 3rd invention of the present invention is a matching circuit chip having a configuration wherein a first shield electrode is disposed on the upper surface of a first dielectric layer, a second dielectric layer is laid (laminated)on said first shield electrode, a first transmission line electrode is disposed on the upper surface of said second dielectric layer, a third dielectric layer is laid on said first transmission line electrode, a second transmission line electrode is disposed on the upper surface of said third dielectric layer, a fourth dielectric layer is laid on said second transmission line electrode, a third transmission line electrode is disposed on the upper surface of said fourth dielectric layer, a fifth dielectric layer is laid on said third transmission line electrode, a second shield electrode is disposed on the upper surface of said fifth dielectric layer, a sixth dielectric layer is laid on said second shield electrode, and at least four end surface electrodes are disposed on the side surfaces of a dielectric comprising said stacked dielectric layers, wherein one end of said first transmission line electrode, one end of said second transmission line electrode and one end of said third transmission line electrode are electrically connected to one another, said end surface electrode connected to the other end of said first transmission line electrode is used as a first filter connection terminal, said end surface electrode connected to the other end of said second transmission line electrode is used as an antenna terminal, said end surface electrode connected to the other end of said third transmission line electrode is used as a second filter connection terminal, and said end surface electrodes connected to said first shield electrode and said second shield electrode are grounded.

With this configuration, for example, the transmission lines are formed in the dielectric layers, whereby the lengths of the lines can be shortened, and a compact matching circuit can be formed.

The 4th invention of the present invention is a matching circuit chip having a configuration wherein a first shield electrode is disposed on the upper surface of a first dielectric layer, a second dielectric layer is laid (laminated) on said first shield electrode, a first transmission line electrode is disposed on the upper surface of said second dielectric layer, a seventh dielectric layer is laid on said first transmission line electrode, a third shield electrode is disposed on the upper surface of said seventh dielectric layer, a third dielectric layer is laid on said third shield electrode, a second transmission line electrode is disposed on the upper surface of said third dielectric layer, an eighth dielectric layer is laid on said second transmission line electrode, a fourth shield electrode is disposed on the upper surface of said eighth dielectric layer, a fourth dielectric layer is laid on said fourth shield electrode, a third transmission line electrode is disposed on the upper surface of said fourth dielectric layer, a fifth dielectric layer is laid on said third transmission line electrode, a second shield electrode is disposed on the upper surface of said fifth dielectric layer, and a sixth dielectric layer is laid on said second shield electrode, and at least four end surface electrodes are disposed on the side surfaces of a dielectric comprising said stacked dielectric layers, wherein one end of said first transmission line electrode, one end of said second transmission line electrode and one end of said third transmission line electrode are electrically connected to one another, said end surface electrode connected to the other end of said first transmission line electrode is used as a first filter connection terminal, said end surface electrode connected to the other end of said second transmission line electrode is used as an antenna terminal, said end surface electrode connected to the other end of said third transmission line electrode is used as a second filter connection terminal, and said end surface electrodes connected to said first shield electrode, said second shield electrode are grounded, said third shield electrode and said fourth shield electrode are grounded.

With this configuration, for example, the transmission line electrodes are separated by the shield electrodes, whereby interference among the lines is eliminated, and a matching circuit can be formed accurately.

The 5th invention of the present invention is a matching circuit chip in accordance with said 3rd or 4th invention, wherein a capacitive electrode is disposed in said dielectric layers and connected to said end surface electrode.

With this configuration, for example, a capacitance can be formed between the terminal and the ground, thereby being effective in easily attaining impedance matching.

The 6th invention of the present invention is a duplexer wherein a transmitting filter or a receiving filter is connected to said first terminal of a matching circuit chip in accordance with any one of said 1st to 5th inventions.

With this configuration, for example, a compact matching circuit can be formed by using less number of components, whereby a duplexer can be formed easily.

The 7th invention of the present invention is a filter with a matching circuit of an integrated shape comprising a first terminal for connection to a predetermined circuit, a transmitting terminal for connection to a transmitting circuit, an antenna terminal for connection to an antenna, a first transmission line, a second transmission line, a third transmission line, a transmission line for a transmitting filter, a plurality of capacitor elements and a plurality of resonators, wherein (1) one end of said first transmission line is connected to one end of said second transmission line and one end of said third transmission line, (2) said transmission line for said transmitting filter is connected to said plural resonators via said capacitor elements, respectively, (3) the other end of said third transmission line is connected to one end of said transmission line for said transmitting filter, (4) the other end of said first transmission line is connected to said first terminal, (5) the other end of said second transmission line is connected to said antenna terminal, and (6) the other end of said transmission line for said transmitting filter is connected to said transmitting terminal.

With this configuration, for example, the characteristic impedances of the first and third transmission lines are converted by the second transmission line, whereby impedance matching can be attained at the antenna terminal, and a notch filter is formed by using the transmission line for the transmitting filter, the plural resonators and the plural capacitor elements. A signal having been input to the transmitting terminal passes through the notch filter and is output to the antenna terminal but not output to the receiving filter connection terminal.

The 8th invention of the present invention is a filter with a matching circuit in accordance with said 7th invention, wherein one end of a fourth transmission line is connected to the connection point of said first transmission line, said second transmission line and said third transmission line, and the other end of said fourth transmission line is grounded.

With this configuration, for example, a load to the second transmission line for performing impedance conversion can be reduced, and impedance matching can be attained in a wide frequency range.

The 9th invention of the present invention is a filter with a matching circuit having a configuration wherein a first shield electrode is disposed on the upper surface of a first dielectric layer, a second dielectric layer is laid (laminated) on said first shield electrode, a first transmission line electrode is disposed on the upper surface of said second dielectric layer, a third dielectric layer is laid on said first transmission line electrode, a plurality of resonator electrodes are disposed on the upper surface of said third dielectric layer, a fourth dielectric layer is laid on said plural resonator electrodes, a transmission line electrode for a transmitting filter and a plurality of capacitor electrodes are disposed on the upper surface of said fourth dielectric layer, a fifth dielectric layer is laid on said transmission line electrode for said transmitting filter and said plural capacitor electrodes, a second transmission line electrode and a third transmission line electrode are disposed on the upper surface of said fifth dielectric layer, a sixth dielectric layer is laid on said second transmission line electrode and said third transmission line electrode, a second shield electrode is disposed on the upper surface of said sixth dielectric layer, a seventh dielectric layer is laid on said second shield electrode, and at least four end surface electrodes are disposed on the side surfaces of a dielectric comprising said stacked dielectric layers, wherein one end of said first transmission line electrode, one end of said second transmission line electrode and one end of said third transmission line electrode are electrically connected to one another, the other end of said third transmission line electrode is electrically connected to one end of said transmission line electrode for said transmitting filter, said capacitor electrodes are disposed so as to be laid over parts of said resonator electrodes arranged in parallel, respectively, said capacitor electrodes are connected to said transmission line electrode for said transmitting filter, said end surface electrode connected to the other end of said first transmission line electrode is used as a receiving filter connection terminal, said end surface electrode connected to the other end of said second transmission line electrode is used as an antenna terminal, said end surface electrode connected to the other end of said transmission line electrode for said transmitting filter is used as a transmitting terminal, and said end surface electrodes connected to said first shield electrode and said second shield electrode are grounded.

With this configuration, for example, the transmission lines and the resonators are formed in the dielectric layers, whereby the lengths of the lines can be shortened. In addition, the capacitor elements are also formed in the dielectric layers, whereby the areas of the capacitor elements can be reduced. As a result, a compact filter with a matching circuit can be formed.

The 10th invention of the present invention is a filter with a matching circuit having a configuration wherein a first shield electrode is disposed on the upper surface of a first dielectric layer, a second dielectric layer is laid (laminated) on said first shield electrode, a first transmission line electrode is disposed on the upper surface of said second dielectric layer, an eighth dielectric layer is laid on said first transmission line electrode, a third shield electrode is disposed on the upper surface of said eighth dielectric layer, a third dielectric layer is laid on said third shield electrode, a plurality of resonator electrodes are disposed on the upper surface of said third dielectric layer, a fourth dielectric layer is laid on said plural resonator electrodes, a transmission line electrode for a transmitting filter and a plurality of capacitor electrodes are disposed on the upper surface of said fourth dielectric layer, a ninth dielectric layer is laid on said transmission line electrode for said transmitting filter and said plural capacitor electrodes, a fourth shield electrode is disposed on the upper surface of said ninth dielectric layer, a fifth dielectric layer is laid on said fourth shield electrode, a second transmission line electrode and a third transmission line electrode are disposed on the upper surface of said fifth dielectric layer, a sixth dielectric layer is laid on said second transmission line electrode and said third transmission line electrode, a second shield electrode is disposed on the upper surface of said sixth dielectric layer, a seventh dielectric layer is laid on said second shield electrode, and at least four end surface electrodes are disposed on the side surfaces of a dielectric comprising said stacked dielectric layers, wherein one end of said first transmission line electrode, one end of said second transmission line electrode and one end of said third transmission line electrode are electrically connected to one another, the other end of said third transmission line electrode is electrically connected to one end of said transmission line electrode for said transmitting filter, said capacitor electrodes are disposed so as to be laid over parts of said resonator electrodes arranged in parallel, respectively, said capacitor electrodes are connected to said transmission line electrode for said transmitting filter, said end surface electrode connected to the other end of said first transmission line electrode is used as a receiving filter connection terminal, said end surface electrode connected to the other end of said second transmission line electrode is used as an antenna terminal, said end surface electrode connected to the other end of said transmission line electrode for said transmitting filter is used as a transmitting terminal, and said end surface electrodes connected to said first shield electrode, said second shield electrode, said third shield electrode and said fourth shield electrode are grounded.

With this configuration, for example, the transmission line electrodes are separated by the shield electrodes, whereby interference among the lines is eliminated, and a matching circuit can be formed accurately.

The 11th invention of the present invention is a filter with a matching circuit in accordance with said 9th or 10th invention, wherein at least one capacitor electrode is disposed in said dielectric layers and connected to one of said end surface electrodes.

With this configuration, for example, a capacitance can be formed between the terminal and the ground, thereby being effective in easily attaining impedance matching.

The 12th invention of the present invention is a filter with a matching circuit in accordance with said 9th or 10th invention, wherein at least one stub line electrode is disposed in said dielectric layers, and said stub line electrode is connected to said antenna terminal, said receiving filter connection terminal, the connection point of said first transmission line electrode, said second transmission line electrode and said third transmission line electrode, or the connection point of said third transmission line electrode and said transmission line electrode for said transmitting filter.

With this configuration, for example, an attenuation pole can be formed, whereby the transmission characteristics of a notch filter can be improved.

The 13th invention of the present invention is a duplexer wherein a receiving filter is connected to said first terminal of a filter with a matching circuit in accordance with any one of said 7th to 12th inventions.

With this configuration, for example, a compact duplexer can be formed easily by using less number of components.

The 14th invention of the present invention is a filter with a matching circuit of an integrated shape comprising a second terminal for connection to a predetermined circuit, a receiving terminal for connection to a receiving circuit, an antenna terminal for connection to an antenna, a first transmission line, a second transmission line, a third transmission line, a plurality of capacitor elements and a plurality of resonators, wherein (1) one end of said first transmission line is connected to one end of said second transmission line and one end of said third transmission line, (2) said resonators arranged in parallel are connected to one another via said capacitor element, (3) said resonator disposed at one end of the arrangement of said plural resonators is connected to the other end of said first transmission line via said capacitor element, (4) said resonator disposed at the other end of the arrangement of said plural resonators is connected to said receiving terminal via said capacitor element, (5) the other end of said second transmission line is connected to said antenna terminal, and (6) the other end of said third transmission line is connected to said second terminal.

With this configuration, for example, the characteristic impedances of the first and third transmission lines are converted by the second transmission line, whereby impedance matching can be attained at the antenna terminal, and a band pass filter can be formed by using the plural resonators and the plural capacitor elements. A signal having been input to the antenna terminal passes through the band pass filter and is output to the receiving terminal but not output to the transmitting filter connection terminal.

The 15th invention of the present invention is a filter with a matching circuit in accordance with said 14th invention, wherein one end of a fourth transmission line is connected to the connection point of said first transmission line, said second transmission line and said third transmission line, and the other end of said fourth transmission line is grounded.

With this configuration, for example, a load to the second transmission line for performing impedance conversion can be reduced, and impedance matching can be attained in a wide frequency range.

The 16th invention of the present invention is a filter with a matching circuit having a configuration wherein a first shield electrode is disposed on the upper surface of a first dielectric layer, a second dielectric layer is laid (laminated) on said first shield electrode, a first transmission line electrode is disposed on the upper surface of said second dielectric layer, a third dielectric layer is laid on said first transmission line electrode, a plurality of resonator electrodes are disposed on the upper surface of said third dielectric layer, a fourth dielectric layer is laid on said plural resonator electrodes, a plurality of capacitor electrodes are disposed on the upper surface of said fourth dielectric layer, a fifth dielectric layer is laid on said plural capacitor electrodes, a second transmission line electrode and a third transmission line electrode are disposed on the upper surface of said fifth dielectric layer, a sixth dielectric layer is laid on said second transmission line electrode and said third transmission line electrode, a second shield electrode is disposed on the upper surface of said sixth dielectric layer, a seventh dielectric layer is laid on said second shield electrode, and at least four end surface electrodes are disposed on the side surfaces of a dielectric comprising said stacked dielectric layers, wherein one end of said first transmission line electrode, one end of said second transmission line electrode and one end of said third transmission line electrode are electrically connected to one another, said resonator electrodes are arranged in parallel, said capacitor electrodes are disposed so that parts thereof are laid over both of said resonator electrodes adjacent to each other, said capacitor electrode disposed so as to be laid over a part of said resonator electrode disposed at one end of the arrangement of said plural resonator electrodes is electrically connected to the other end of said first transmission line, said end surface electrode connected to said capacitor electrode disposed so as to be laid over a part of said resonator electrode disposed at the other end of the arrangement of said plural resonator electrodes is used as a receiving terminal, said end surface electrode connected to the other end of said second transmission line electrode is used as an antenna terminal, said end surface electrode connected to the other end of said third transmission line electrode is used as a transmitting filter connection terminal, and said end surface electrodes connected to said first shield electrode and said second shield electrode are grounded.

With this configuration, for example, the transmission lines and the resonators are formed in the dielectric layers, whereby the lengths of the lines can be shortened. In addition, the capacitor elements are also formed in the dielectric layers, whereby the areas of the capacitor elements can be reduced. As a result, a compact filter with a matching circuit can be formed.

The 17th invention of the present invention is a filter with a matching circuit having a configuration wherein a first shield electrode is disposed on the upper surface of a first dielectric layer, a second dielectric layer is laid (laminated) on said first shield electrode, a first transmission line electrode is disposed on the upper surface of said second dielectric layer, an eighth dielectric layer is laid on said first transmission line electrode, a third shield electrode is disposed on the upper surface of said eighth dielectric layer, a third dielectric layer is laid on said third shield electrode, a plurality of resonator electrodes are disposed on the upper surface of said third dielectric layer, a fourth dielectric layer is laid on said plural resonator electrodes, a plurality of capacitor electrodes are disposed on the upper surface of said fourth dielectric layer, a ninth dielectric layer is laid on said plural capacitor electrodes, a fourth shield electrode is disposed on the upper surface of said ninth dielectric layer, a fifth dielectric layer is laid on said fourth shield electrode, a second transmission line electrode and a third transmission line electrode are disposed on the upper surface of said fifth dielectric layer, a sixth dielectric layer is laid on said second transmission line electrode and said third transmission line electrode, a second shield electrode is disposed on the upper surface of said sixth dielectric layer, a seventh dielectric layer is laid on said second shield electrode, and at least four end surface electrodes are disposed on the side surfaces of a dielectric comprising said stacked dielectric layers, wherein one end of said first transmission line electrode, one end of said second transmission line electrode and one end of said third transmission line electrode are electrically connected to one another, said resonator electrodes are arranged in parallel, said capacitor electrodes are disposed so that parts thereof are laid over both of said resonator electrodes adjacent to each other, said capacitor electrode disposed so as to be laid over a part of said resonator electrode disposed at one end of the arrangement of said plural resonator electrodes is electrically connected to the other end of said first transmission line, said end surface electrode connected to said capacitor electrode disposed so as to be laid over a part of said resonator electrode disposed at the other end of the arrangement of said plural resonator electrodes is used as a receiving terminal, said end surface electrode connected to the other end of said second transmission line electrode is used as an antenna terminal, said end surface electrode connected to the other end of said third transmission line electrode is used as a transmitting filter connection terminal, and said end surface electrodes connected to said first shield electrode, said second shield electrode, said third shield electrode and said fourth shield electrode are grounded.

With this configuration, for example, the transmission line electrodes are separated by the shield electrodes, whereby interference among the lines is eliminated, and a matching circuit can be formed accurately.

The 18th invention of the present invention is a filter with a matching circuit in accordance with said 16th or 17th invention, wherein at least one capacitive electrode is disposed in said dielectric layers and connected to one of said end surface electrodes.

With this configuration, for example, a capacitance can be formed between the terminal and the ground, thereby being effective in easily attaining impedance matching.

The 19th invention of the present invention is a filter with a matching circuit in accordance with said 16th or 17th invention, wherein at least one stub line electrode is disposed in said dielectric layers, and said stub line electrode is connected to said antenna terminal, said transmitting filter connection terminal, the connection point of said first transmission line electrode, said second transmission line electrode and said third transmission line electrode, or the connection point of said first transmission line electrode and said capacitor electrode.

With this configuration, for example, an attenuation pole can be formed, whereby the transmission characteristics of a band pass filter can be improved.

The 20th invention of the present invention is a duplexer wherein a transmitting filter is connected to said second terminal of a filter with a matching circuit in accordance with any one of said 14th to 19th inventions.

With this configuration, for example, a compact duplexer can be formed easily by using less number of components.

The 21st invention of the present invention is a duplexer of an integrated shape comprising a receiving terminal for connection to a receiving circuit, a transmitting terminal for connection to a transmitting terminal, an antenna terminal for connection to an antenna, a first transmission line, a second transmission line, a third transmission line, a transmission line for a transmitting filter, a plurality of capacitor elements for said transmitting filter, a plurality of capacitor elements for a receiving filter, a plurality of resonators for said transmitting filter and a plurality of resonators for said receiving filter, wherein (1) one end of said first transmission line is connected to one end of said second transmission line and one end of said third transmission line, (2) said transmission line for said transmitting filter is connected to said plural resonators for said transmitting filter via said capacitor elements for said transmitting filter, respectively, (3) the other end of said third transmission line is connected to one end of said transmission line for said transmitting filter, (4) the other end of said transmission line for said transmitting filter is connected to said transmitting terminal, (5) said resonators for said receiving filter arranged in parallel are connected to one another via said capacitor elements for said receiving filter, (6) said resonator disposed at one end of the arrangement of said plural resonators for said receiving filter is connected to the other end of said first transmission line via said capacitor element for said receiving filter, (7) said resonator disposed at the other end of the arrangement of said plural resonators is connected to said receiving terminal via said capacitor element for said receiving filter, and (8) the other end of said second transmission line is connected to said antenna terminal.

With this configuration, for example, the characteristic impedances of the first and third transmission lines are converted by the second transmission line, whereby impedance matching can be attained at the antenna terminal. A notch filter is formed by using the transmission line for the transmitting filter, the plural resonators for the transmitting filter and the plural capacitor elements for the transmitting filter, and a band pass filter is formed by using the plural resonators for the receiving filter and the plural capacitor elements for the receiving filter. A signal having been input to the transmitting terminal passes through the notch filter and is output to the antenna terminal but not output to the receiving terminal, and a signal having been input to the antenna terminal passes through the band pass filter and is output to the receiving terminal but not output to the transmitting terminal.

The 22nd invention of the present invention is a duplexer in accordance with said 21st invention, wherein one end of a fourth transmission line is connected to the connection point of said first transmission line, said second transmission line and said third transmission line, and the other end of said fourth transmission line is grounded.

With this configuration, for example, a load to the second transmission line for performing impedance conversion can be reduced, and impedance matching can be attained in a wide frequency range.

The 23rd invention of the present invention is a duplexer having a configuration wherein a first shield electrode is disposed on the upper surface of a first dielectric layer, a second dielectric layer is laid (laminated) on said first shield electrode, a first transmission line electrode is disposed on the upper surface of said second dielectric layer, a third dielectric layer is laid on said first transmission line electrode, a plurality of resonator electrodes for a transmitting filter and a plurality of resonator electrodes for a receiving filter are disposed on the upper surface of said third dielectric layer, a fourth dielectric layer is laid on said plural resonator electrodes for said transmitting filter and plural resonator electrodes for said receiving filter, a transmission line electrode for said transmitting filter, a plurality of capacitor electrodes for said transmitting filter and a plurality of capacitor electrodes for said receiving filter are disposed on the upper surface of said fourth dielectric layer, a fifth dielectric layer is laid on said transmission line electrode for said transmitting filter, said plural capacitor electrodes for said transmitting filter and said plural capacitor electrodes for said receiving filter, a second transmission line electrode and a third transmission line electrode are disposed on the upper surface of said fifth dielectric layer, a sixth dielectric layer is laid on said second transmission line electrode and said third transmission line electrode, a second shield electrode is disposed on the upper surface of said sixth dielectric layer, a seventh dielectric layer is laid on said second shield electrode, and at least four end surface electrodes are disposed on the side surfaces of a dielectric comprising said stacked dielectric layers, wherein one end of said first transmission line electrode, one end of said second transmission line electrode and one end of said third transmission line electrode are electrically connected to one another, the other end of said third transmission line electrode is electrically connected to one end of said transmission line electrode for said transmitting filter, said capacitor electrodes for said transmitting filter are disposed so as to be laid over parts of said resonator electrodes for said transmitting filter arranged in parallel, respectively, said capacitor electrodes for said transmitting filter are connected to said transmission line electrode for said transmitting filter, said end surface electrode connected to the other end of said transmission line electrode for said transmitting filter is used as a transmitting terminal, said resonator electrodes for said receiving filter are disposed in parallel, said capacitor electrodes for said receiving filter are disposed so that parts thereof are laid over both of said resonator electrodes for said receiving filter adjacent to each other, said capacitor electrode for said receiving filter disposed so as to be laid over a part of said resonator electrode for said receiving filter disposed at one end of the arrangement of said plural resonator electrodes for said receiving filter is electrically connected to the other end of said first transmission line, said end surface electrode connected to said capacitor electrode for said receiving filter disposed so as to be laid over a part of said resonator electrode for said receiving filter disposed at the other end of the arrangement of said plural resonator electrodes for said receiving filter is used as a receiving terminal, said end surface electrode connected to the other end of said second transmission line electrode is used as an antenna terminal, and said end surface electrodes connected to said first shield electrode and said second shield electrode are grounded.

With this configuration, for example, the transmission line electrodes and the resonator electrodes are formed in the dielectric layers, whereby the lengths of the lines can be shortened. In addition, the capacitor electrodes are also formed in the dielectric layers, whereby the areas of the capacitor electrodes can be reduced. As a result, a compact duplexer can be formed.

The 24th invention of the present invention is a duplexer having a configuration wherein a first shield electrode is disposed on the upper surface of a first dielectric layer, a second dielectric layer is laid (laminated) on said first shield electrode, a first transmission line electrode is disposed on the upper surface of said second dielectric layer, an eighth dielectric layer is laid on said first transmission line electrode, a third shield electrode is disposed on the upper surface of said eighth dielectric layer, a third dielectric layer is laid on said third shield electrode, a plurality of resonator electrodes for a transmitting filter and a plurality of resonator electrodes for a receiving filter are disposed on the upper surface of said third dielectric layer, a fourth dielectric layer is laid on said plural resonator electrodes for said transmitting filter and plural resonator electrodes for said receiving filter, a transmission line electrode for said transmitting filter, a plurality of capacitor electrodes for said transmitting filter and a plurality of capacitor electrodes for said receiving filter are disposed on the upper surface of said fourth dielectric layer, a ninth dielectric layer is laid on said transmission line electrode for said transmitting filter, said plural capacitor electrodes for said transmitting filter and said plural capacitor electrodes for said receiving filter, a fourth shield electrode is disposed on the upper surface of said ninth dielectric layer, a fifth dielectric layer is laid on said fourth shield electrode, a second transmission line electrode and a third transmission line electrode are disposed on the upper surface of said fifth dielectric layer, a sixth dielectric layer is laid on said second transmission line electrode and said third transmission line electrode, a second shield electrode is disposed on the upper surface of said sixth dielectric layer, a seventh dielectric layer is laid on said second shield electrode, and at least four end surface electrodes are disposed on the side surfaces of a dielectric comprising said stacked dielectric layers, wherein one end of said first transmission line electrode, one end of said second transmission line electrode and one end of said third transmission line electrode are electrically connected to one another, the other end of said third transmission line electrode is electrically connected to one end of said transmission line electrode for said transmitting filter, said capacitor electrodes for said transmitting filter are disposed so as to be laid over parts of said resonator electrodes for said transmitting filter arranged in parallel, respectively, said capacitor electrodes for said transmitting filter are connected to said transmission line electrode for said transmitting filter, said end surface electrode connected to the other end of said transmission line electrode for said transmitting filter is used as a transmitting terminal, said resonator electrodes for said receiving filter are disposed in parallel, said capacitor electrodes for said receiving filter are disposed so that parts thereof are laid over both of said resonator electrodes for said receiving filter adjacent to each other, said capacitor electrode for said receiving filter disposed so as to be laid over a part of said resonator electrode for said receiving filter disposed at one end of the arrangement of said plural resonator electrodes for said receiving filter is electrically connected to the other end of said first transmission line, said end surface electrode connected to said capacitor electrode for said receiving filter disposed so as to be laid over a part of said resonator electrode for said receiving filter disposed at the other end of the arrangement of said plural resonator electrodes for said receiving filter is used as a receiving terminal, said end surface electrode connected to the other end of said second transmission line electrode is used as an antenna terminal, and said end surface electrodes connected to said first shield electrode, said second shield electrode, said third shield electrode and said fourth shield electrode are grounded.

With this configuration, for example, the transmission line electrodes are separated by the shield electrodes, whereby interference among the lines is eliminated, and a matching circuit can be formed accurately.

The 25th invention of the present invention is a duplexer in accordance with said 23rd or 24th invention, wherein at least one capacitive electrode is disposed in said dielectric layers and connected to one of said end surface electrodes.

With this configuration, for example, a capacitance can be formed between the terminal and the ground, thereby being effective in easily attaining impedance matching.

The 26th invention of the present invention is a duplexer in accordance with said 23rd or 24th invention, wherein at least one stub line is disposed in said dielectric layers, and said stub line is connected to said antenna terminal, said transmitting terminal, the connection point of said first transmission line electrode, said second transmission line electrode and said third transmission line electrode or the connection point of said third transmission line electrode and said transmission line electrode for said transmitting filter.

With this configuration, for example, an attenuation pole can be formed, whereby the transmission characteristics of a notch filter can be improved.

The 27th invention of the present invention is a duplexer in accordance with said 23rd or 24th invention, wherein at least one stub line is disposed in said dielectric layers, and said stub line is connected to said antenna terminal, said receiving terminal, the connection point of said first transmission line electrode, said second transmission line electrode and said third transmission line electrode or the connection point of said first transmission line electrode and said capacitor electrode for said receiving filter.

With this configuration, for example, an attenuation pole can be formed, whereby the transmission characteristics of a band pass filter can be improved.

The 28th invention of the present invention is a filter with a matching circuit in accordance with said 7th invention, wherein the line condition of said second transmission line is adjusted so that the impedance matching between said antenna terminal and said first terminal can be attained and so that the impedance matching between said antenna terminal and said transmission line for said transmitting filter can be attained.

The 29th invention of the present invention is a filter with a matching circuit in accordance with said 14th invention, wherein the line condition of said second transmission line is adjusted so that the impedance matching between said antenna terminal and said second terminal can be attained and so that the impedance matching between said antenna terminal and the other end of said first transmission line can be attained.

The 30th invention of the present invention is a duplexer in accordance with said 21st invention, wherein the line condition of said second transmission line is adjusted so that the impedance matching between said antenna terminal and said transmission line for said transmitting filter can be attained and so that the impedance matching between said antenna terminal and the other end of said first transmission line can be attained.

With this configuration, for example, the second transmission line operates as an impedance converter, whereby a filter with a matching circuit capable of easily attaining impedance matching is formed.

The 31st invention of the present invention is a filter with a matching circuit comprising:

an antenna terminal for connection to an antenna;

an antenna terminal connection transmission line, one end of which is connected to said antenna terminal;

one transmission line among a plurality of transmission lines, one end of each transmission line is connected to the other end of said antenna terminal connection transmission line;

other transmission line among said plural transmission lines;

a transmitting or receiving filter circuit connected to the other end of said one transmission line; and a circuit terminal for connection to a predetermined circuit, connected to the other end of said other transmission line;

wherein the line condition of said antenna terminal connection transmission line is adjusted so that the impedance matching between said antenna terminal and said circuit terminal can be attained and so that the impedance matching between said antenna terminal and said filter circuit can be attained.

With this configuration, for example, the second transmission line operates as an impedance converter, whereby a duplexer capable of easily attaining impedance matching is formed.

The 32nd invention of the present invention is a mobile communication apparatus comprising a matching circuit chip, a filter with a matching circuit or a duplexer in accordance with any one of said 1st to 31st inventions.

With this configuration, for example, a compact duplexer can be formed easily by using less number of components. As a result, the configuration is effective in achieving a compact mobile communication apparatus having a simple configuration.

As described above, with the present invention, for example, the characteristic impedances of the first and third transmission lines are converted by the second transmission line, whereby the impedance matching between the transmitting filer and the receiving filter can be attained at the antenna terminal. As a result, a compact matching chip can be achieved, while the degree of freedom of design of the first and third transmission lines remains unchanged.

Furthermore, a load to the second transmission line can be reduced by connecting the fourth transmission line to the connection point of the first, second and third transmission lines, and impedance matching can be attained in a wide frequency range.

Furthermore, the first and second shield electrodes, and the first, second and third transmission line electrodes are formed in the dielectric layers, whereby the lengths of the lines can be shortened, and a compact matching circuit chip can be formed.

Furthermore, the first, second, third and fourth shield electrodes, and the first, second and third transmission line electrodes are formed in the dielectric layers, whereby the transmission line electrodes can be separated by the shield electrodes, and a matching circuit chip can be formed accurately.

Furthermore, a capacitance can be formed between the terminal and the ground by forming the capacitive electrodes in the dielectric layers, whereby a matching circuit chip capable of easily attaining impedance matching can be formed.

Furthermore, a duplexer can be formed by connecting a transmitting filter and a receiving filter to the matching circuit chip of the present invention, a compact matching circuit can be formed by using less number of components, and a duplexer can be formed easily.

Furthermore, the characteristic impedances of the first and third transmission lines are converted by the second transmission line, whereby the impedance matching between the notch filter comprising the transmission line for the transmitting filer, the capacitor elements and the resonators and the element connected to the receiving filter connection terminal can be attained at the antenna terminal. As a result, a compact filter with a matching circuit can be achieved, while the degree of freedom of design of the first and third transmission lines remains unchanged.

Furthermore, a load to the second transmission line can be reduced by connecting the fourth transmission line to the connection point of the first, second and third transmission lines, and impedance matching for the notch filter and the matching circuit can be attained in a wide frequency range.

Furthermore, the first and second shield electrodes, and the first, second and third transmission line electrodes, the transmission line electrode for the transmitting filter, the plural capacitor electrodes and the plural resonator electrodes are formed in the dielectric layers, whereby the lengths of the lines and the lengths of the resonators can be shortened, and the areas of the capacitor electrodes can be reduced. As a result, a compact filter with a matching circuit can be formed.

Furthermore, the first, second, third and fourth shield electrodes, the first, second and third transmission line electrodes, the transmission line electrode for the transmitting filter, the plural capacitor electrodes and the plural resonator electrodes are formed in the dielectric layers, whereby the transmission line electrodes can be separated by the shield electrodes, and a filter with a matching circuit can be formed accurately.

Furthermore, a capacitance can be formed between the terminal and the ground by forming the capacitive electrodes in the dielectric layers, whereby a filter with a matching circuit capable of easily attaining impedance matching for the notch filter and the matching circuit can be formed.

Furthermore, an attenuation pole can be formed in the harmonic band of the notch filter by forming a short stub line electrode in the dielectric layer, whereby a filter with a matching circuit having a high attenuation amount in the harmonic band can be formed.

Furthermore, a duplexer can be formed by connecting a receiving filter to the filter with a matching circuit of the present invention, whereby the matching circuit and the transmitting filter can be made compact by using less number of components, whereby the duplexer can be formed easily.

Furthermore, the characteristic impedances of the first and third transmission lines are converted by the second transmission line, whereby the impedance matching between the band pass filter comprising the capacitor elements and the resonators and the element connected to the transmitting filter connection terminal can be attained at the antenna terminal. As a result, a compact filter with a matching circuit can be achieved, while the degree of freedom of design of the first and third transmission lines remains unchanged.

Furthermore, a load to the second transmission line can be reduced by connecting the fourth transmission line to the connection point of the first, second and third transmission lines, and impedance matching for the band pass filter and the matching circuit can be attained in a wide frequency range.

Furthermore, the first and second shield electrodes, and the first, second and third transmission line electrodes, the plural capacitor electrodes and the plural resonator electrodes are formed in the dielectric layers, whereby the lengths of the lines and the lengths of the resonators can be shortened, and the areas of the capacitor electrodes can be reduced. As a result, a compact filter with a matching circuit can be formed.

Furthermore, the first, second, third and fourth shield electrodes, the first, second and third transmission line electrodes, the plural capacitor electrodes and the plural resonator electrodes are formed in the dielectric layers, whereby the transmission line electrodes can be separated by the shield electrodes, and a filter with a matching circuit can be formed accurately.

Furthermore, a capacitance can be formed between the terminal and the ground by forming the capacitive electrodes in the dielectric layers, whereby a filter with a matching circuit capable of easily attaining impedance matching for the band pass filter and the matching circuit can be formed.

Furthermore, an attenuation pole can be formed in the harmonic band of the band pass filter by forming a short stub line electrode in the dielectric layer, whereby a filter with a matching circuit having a high attenuation amount in the harmonic band can be formed.

Furthermore, a duplexer can be formed by connecting a transmitting filter to the filter with a matching circuit of the present invention, whereby the matching circuit and the receiving filter can be made compact by using less number of components, whereby the duplexer can be formed easily.

Furthermore, the characteristic impedances of the first and third transmission lines are converted by the second transmission line, whereby the impedance matching between the notch filter comprising the transmission line for the transmitting filter, the capacitor elements for the transmitting filter and the resonators for the transmitting filter and the band pass filter comprising the capacitor elements for the receiving filter and the resonators for the receiving filter can be attained at the antenna terminal. As a result, a duplexer can be achieved, while the degree of freedom of design of the first and third transmission lines remains unchanged.

Furthermore, a load to the second transmission line can be reduced by connecting the fourth transmission line to the connection point of the first, second and third transmission lines, and impedance matching for the notch filter and the band pass filter can be attained in a wide frequency range.

Furthermore, the first and second shield electrodes, and the first, second and third transmission line electrodes, the transmission line electrode for the transmitting filter, the plural capacitor electrodes for the transmitting filter, the plural capacitor electrodes for the receiving filter, the plural resonator electrodes for the transmitting filter and the plural resonator electrodes for the receiving filter are formed in the dielectric layers, whereby the lengths of the lines and the lengths of the resonators can be shortened, and the areas of the capacitor electrodes can be reduced. As a result, a compact duplexer can be formed.

Furthermore, the first, second, third and fourth shield electrodes, the first, second and third transmission line electrodes, the transmission line electrode for the transmitting filter, the plural capacitor electrodes for the transmitting filter, the plural capacitor electrodes for the receiving filter, the plural resonator electrodes for the transmitting filter and the plural resonator electrodes for the receiving filter are formed in the dielectric layers, whereby the transmission line electrodes can be separated by the shield electrodes, and a duplexer can be formed accurately.

Furthermore, a capacitance can be formed between the terminal and the ground by forming the capacitive electrodes in the dielectric layers, whereby a duplexer capable of easily attaining impedance matching for the notch filter and the band pass filter can be formed.

Furthermore, an attenuation pole can be formed in the harmonic band of the notch filter and the band pass filter by forming a short stub line electrode in the dielectric layer, whereby a duplexer having a high attenuation amount in the harmonic band can be formed.

Furthermore, by incorporating the duplexer of the present invention described above in part of the circuit of a communication apparatus such as a cellular phone, the communication apparatus can be made compact drastically.

REFERENCE CODE DESIGNATION

101 First filter connection terminal

102 Antenna terminal

103 Second filter connection terminal

104 First transmission line

105 Second transmission line

106 Third transmission line

107 External view of the main unit of a matching circuit chip

DETAILED DESCRIPTION OF PREFERRED EMBODIMENTS

Embodiments in accordance with the present invention will be described below referring to the accompanying drawings.

(EMBODIMENT 1)

Figure 1A:
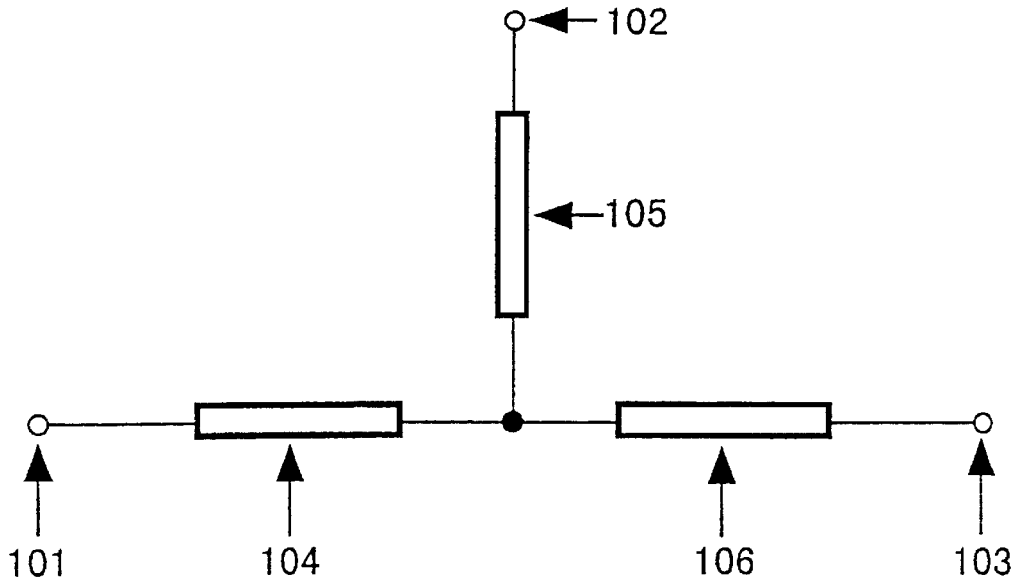
FIG. 1A is a circuit diagram of a matching circuit chip in accordance with embodiment 1 of the present invention.

FIG. 1A is a circuit diagram of a matching circuit chip in accordance with embodiment 1 of the present invention. Referring to the figure, the configuration of the matching circuit chip in accordance with the present embodiment will be described below.

In FIG. 1A, the matching circuit chip has a main unit 107 of an integrated shape comprising a first transmission line 104, a second transmission line 105 and a third transmission line 106. One end of the first transmission line 104 is connected to one end of the second transmission line 105 and one end of the third transmission line 106. In addition, the other end of the first transmission line 104 is connected to a first filter connection terminal 101, the other end of the second transmission line 105 is connected to an antenna terminal 102, and the other end of the third transmission line 106 is connected to a second filter connection terminal 103.

Figure 1B:
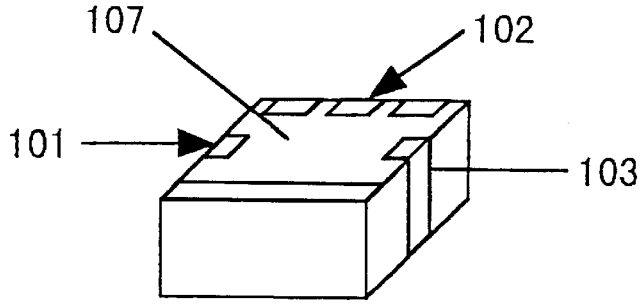
FIG. 1B is an external view showing the matching circuit chip in accordance with embodiment 1 of the present invention.

FIG. 1B is an external view showing the main unit of the matching circuit chip in accordance with embodiment 1. In FIG. 1B, the main unit 107 of the matching circuit chip incorporates the first transmission line 104, the second transmission line 105 and the third transmission line 106, and is provided on the sides thereof with the first filter connection terminal 101, the antenna terminal 102 and the second filter connection terminal 103. A first terminal in accordance with the present invention corresponds to the first filter connection terminal 101. In addition, the second terminal in accordance with the present invention corresponds to the second filter connection terminal 103.

The operation of the matching circuit chip configured as described above will be described below.

The first transmission line 104 is set to have a line length equal to nearly one quarter wavelength in the frequency band of an element connected to the second filter connection terminal 103, and the third transmission line 106 is set to have a line length equal to nearly one quarter wavelength in the frequency band of an element connected to the first filter connection terminal 101.

It is herein assumed that the impedance at the connection point of the first transmission line 104 and the third transmission line 106 is ZA1, that the impedance at the antenna terminal 102 is ZB1, and that the characteristic impedance of the second transmission line 105 is Z01. By using Equation 1 described below, i. e., a general equation regarding impedance matching, wherein 50 is assigned to ZB1 so that ZB1=50 ohms is obtained in the entire frequency bands of elements connected to the first filter connection terminal 101 and the second filter connection terminal 103:

$$Z01 \times Z01 = ZA1 \times 50 \quad \text{[Equation 1]}$$

the characteristic impedance Z01 and the line length of the second transmission line 105 are set.

In this case, the second transmission line 105 operates as an impedance converter, and converts the impedance ZA1 at the connection point of the first transmission line 104 and the third transmission line 106 to 50 ohms. As a result, by adjusting the line condition of the second transmission line 105, the impedance matching between the element connected to the first filter connection terminal 101 and the antenna terminal 102 can be attained, and the impedance matching between the element connected to the second filter connection terminal 103 and the antenna terminal 102 can be attained, while the degree of freedom of design of the first transmission line 104 and the third transmission line 106 remains unchanged.

Therefore, it is possible to form a matching circuit chip by increasing the dielectric coefficient of the main unit 107 comprising the first transmission line 104 and the third transmission line 106 and by shortening the line lengths thereof.

With the above-mentioned configuration, the present embodiment operates as a compact matching circuit chip capable of being formed of a simple circuit.

Next, a modified example of the above-mentioned embodiment will be described below referring to FIGS. 2A and 2B.

Figure 2A:
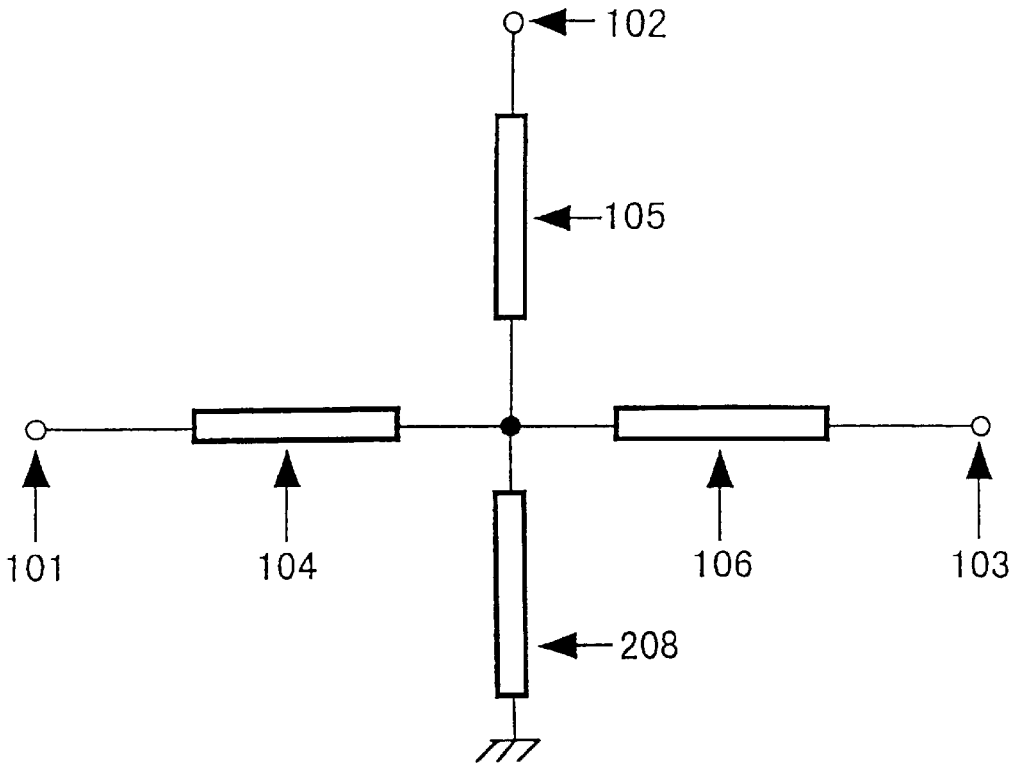
FIG. 2A is a circuit diagram of a matching circuit chip in accordance with a modification of embodiment 1 of the present invention.
Figure 2B:
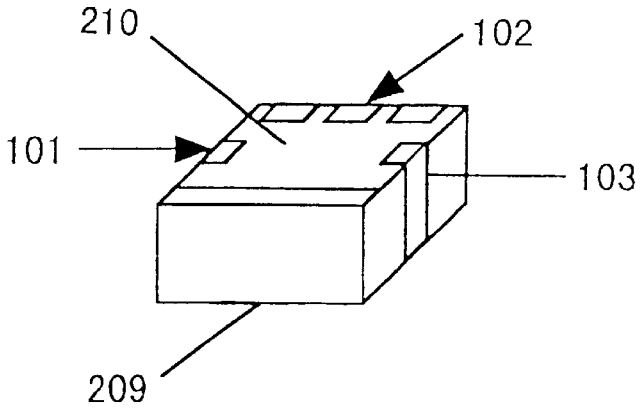
FIG. 2B is an external view showing the matching circuit chip in accordance with the modification of embodiment 1 of the present invention.

Although the circuit of the matching circuit chip in accordance with the above-mentioned embodiment comprises three transmission lines, it is possible to have a configuration wherein one end of a fourth transmission line 208 is connected to the connection point of the three transmission lines as shown in FIG. 2A, and the other end thereof is grounded via a ground terminal 210 provided on a side surface of the main unit 209 of the matching circuit chip as shown in FIG. 2B.

In this case, by adding the fourth transmission line 208, line conditions for matching can be selected from a wider selection range. In other words,the line conditions for the second transmission line 105 can be selected from a wider selection range, unlike the case of the configuration shown in FIG. 1A wherein matching depends only the line conditions of the second transmission line 105. In addition, the addition of the fourth transmission line 208 is also effective in widening the frequency range wherein impedance matching can be attained.

Although the transmission lines in accordance with the present embodiment can be formed by various methods, the present invention is not limited to details about such methods.

(EMBODIMENT 2)

Figure 3:
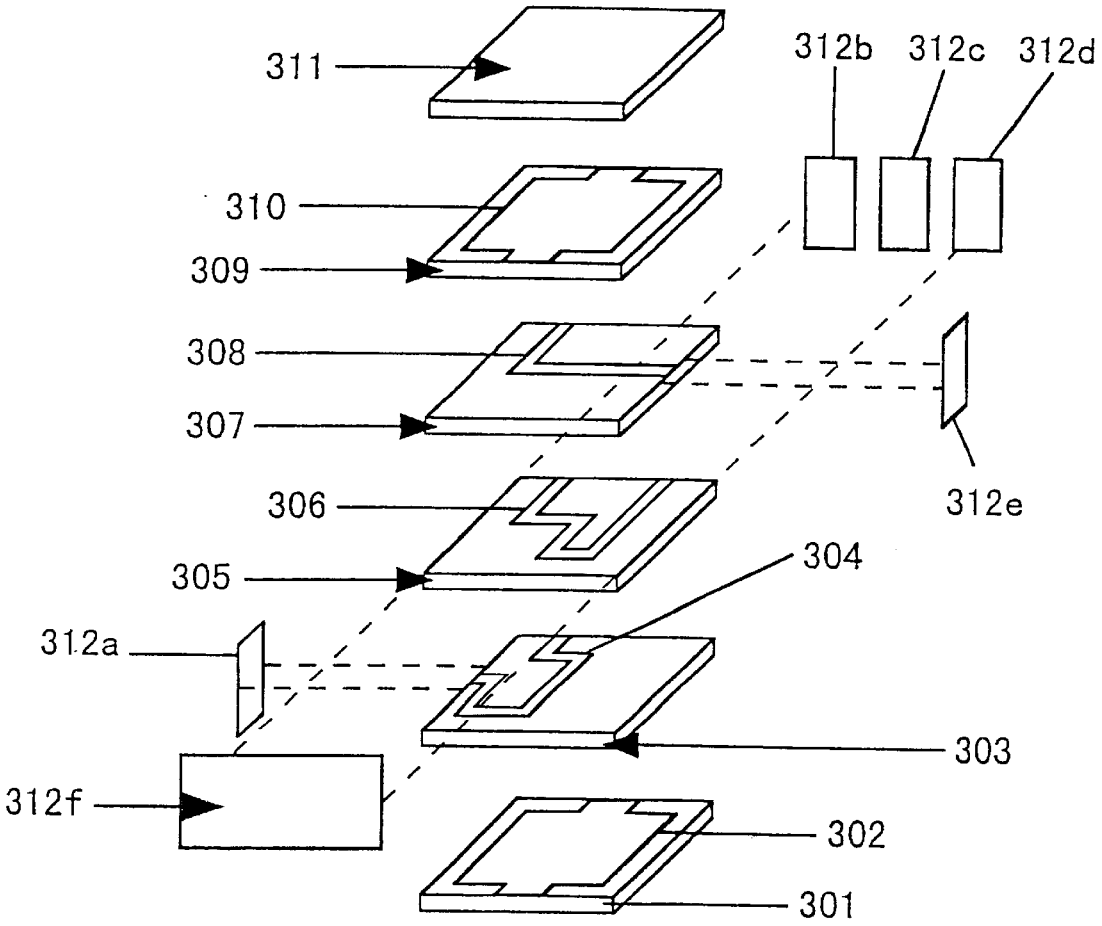
FIG. 3 is a perspective view showing a matching circuit chip in accordance with embodiment 2 of the present invention.

FIG. 3 shows a matching circuit chip in accordance with embodiment 2 of the present invention.

As shown in FIG. 3, a first shield electrode 302 is disposed on the upper surface of a first dielectric layer 301, a second dielectric layer 303 is laid (laminated) on the first shield electrode 302, and a first transmission line electrode 304 is disposed on the upper surface of the second dielectric layer 303. In addition, a third dielectric layer 305 is laid on the electrode 304, and a second transmission line electrode 306 is disposed on the upper surface of the third dielectric layer 305. Furthermore, a fourth dielectric layer 307 is laid on the electrode 306, and a third transmission line electrode 308 is disposed on the upper surface of the fourth dielectric layer 307. Moreover, a fifth dielectric layer 309 is laid on the electrode 308, a second shield electrode 310 is disposed on the upper surface of the fifth dielectric layer 309, and a sixth dielectric layer 311 is laid on the electrode 310. Additionally, six end surface electrodes 312 are disposed on the side surfaces of a dielectric comprising the dielectric layers, whereby the first transmission line electrode 304 is connected to an end surface electrode 312*a,* the second transmission line electrode 306 is connected to an end surface electrode 312*d,* and the third transmission line electrode 308 is connected to an end surface electrode 312*e.* Besides, the first shield electrode 302 and the second shield electrode 310 are connected to each other and grounded via an end surface electrode 312*c* and an end surface electrode 312*f*, and the first transmission line electrode 304, the second transmission line electrode 306 and the third transmission line electrode 307 are connected to one another via an end surface electrode 312*b.*

The operation of the matching circuit chip configured as described above will be described below.

Since the operation of the matching circuit chip in accordance with the present embodiment is basically the same as that of the matching circuit chip described in the explanation of embodiment 1, the operation is not detailed herein.

The length of the first transmission line electrode 304 is set at nearly one quarter wavelength in the frequency band of an element connected to the end surface electrode 312*e,* and the length of the third transmission line electrode 308 is set at nearly one quarter wavelength in the frequency band of an element connected to the end surface electrode 312*a.* In addition, it is assumed that the impedance at the end surface electrode 312*b* is Zb2, that the impedance at the end surface electrode 312*d* is Zd2, and that the characteristic impedance of the second transmission line electrode 306 is Z02. By using Equation 2 described below, i. e., a general equation regarding impedance matching, 50 is assigned to Zd2 so that Zd2 50 ohms is obtained in the entire frequency bands of elements connected to the end surface electrode 312*a* and the end surface electrode 312*e:*

$$Z02 \times Z02 = Zb2 \times 50 \qquad \text{[Equation 2]}$$

the characteristic impedance Z02 and the line length of the second transmission line electrode 306 are set.

In this case, the second transmission line electrode 306 operates as an impedance converter, and converts the impedance Zb2 of the end surface electrode 312*b* to 50 ohms. As a result, by adjusting the line condition of the second transmission line electrode 306, the impedance matching between the end surface electrode 312*a* and the end surface electrode 312*d* can be attained, and the impedance matching between an element connected to the end surface electrode 312*e* and the end surface electrode 312*d* can be attained.

Therefore, it is possible to form a compact component having a shorter line length by increasing the dielectric coefficients of the dielectric layers used in the present embodiment. Furthermore, it is possible to form a compact matching circuit chip by using the end surface electrode 312*a* as a first filter connection terminal, the end surface electrode 312*d* as an antenna terminal, and the end surface electrode 312*e* as a second filter connection terminal.

With the above-mentioned configuration, the present embodiment operates as a compact matching circuit chip capable of being formed of a simple circuit.

The shield electrodes in the present embodiment are two layers: the first shield electrode 302 and the second shield electrode 310. However, the present embodiment is not limited to this configuration, and such a configuration as shown in FIG. 4 may also be used.

Figure 4:
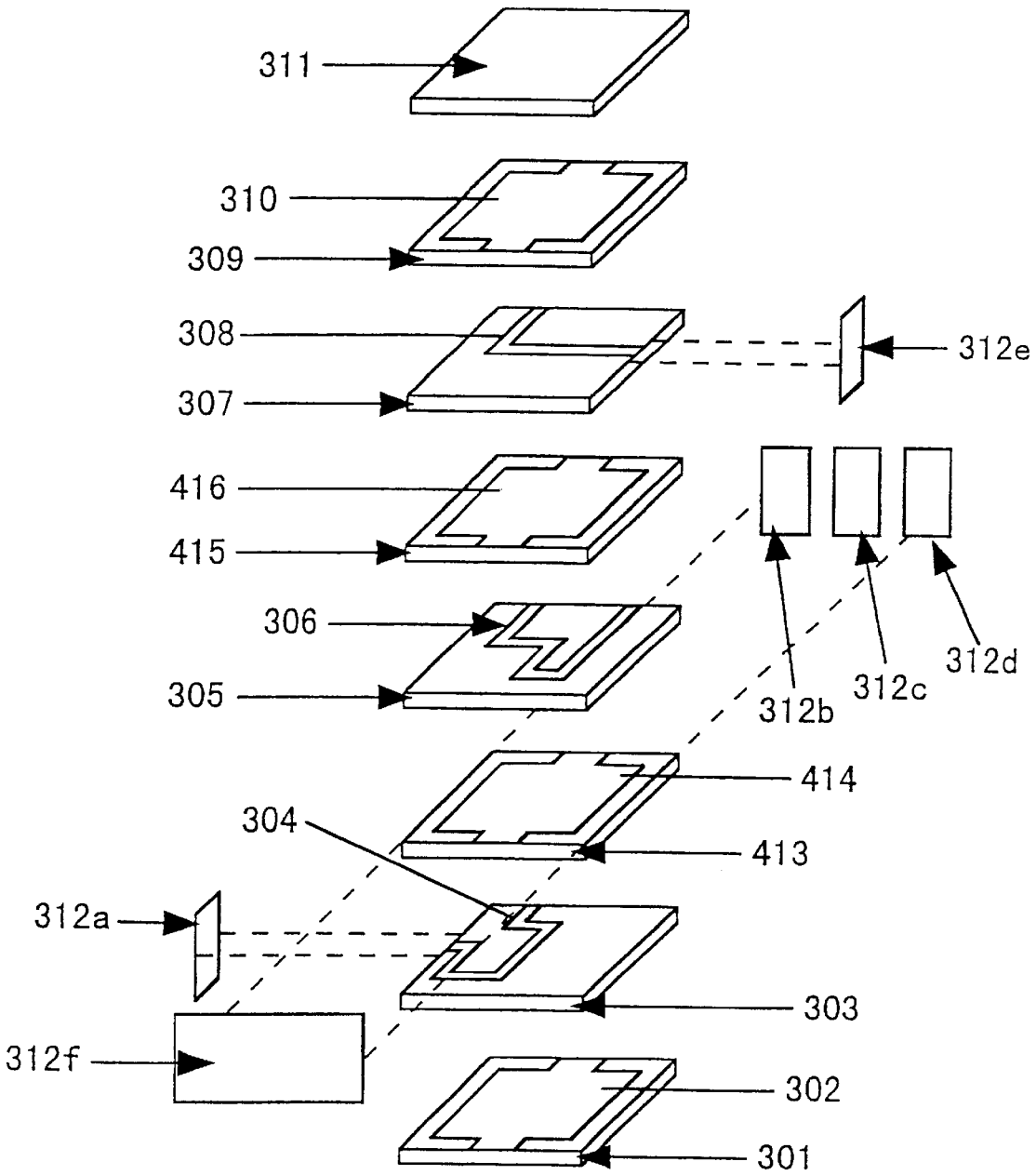
FIG. 4 is a perspective view showing another configuration of the matching circuit chip in accordance with embodiment 2 of the present invention.

In other words, in FIG. 4, a seventh dielectric layer 413 is laid on the first transmission line electrode 304, and a third shield electrode 414 is disposed on the upper surface of the seventh dielectric layer 413. Furthermore, the third dielectric layer 305 is laid on the electrode 414, an eighth dielectric layer 415 is laid on the second transmission line electrode 306, a fourth shield electrode 416 is disposed on the upper surface of the eighth dielectric layer 415, and the fourth dielectric layer 307 is laid on the electrode 416.

In this case, since the first transmission line electrode 304, the second transmission line electrode 306 and the third transmission line electrode 308 are separated by the shield electrodes, electromagnetic coupling among the three transmission line electrodes is eliminated, thereby being effective in accurately achieving a matching circuit chip.

In addition, a capacitive electrode may be provided in the dielectric layers of the present embodiment. For example, a capacitor may be formed between the end surface electrode 312*a* and the ground. In this case, impedance matching can be attained more easily.

Furthermore, the end surface electrode 312*b,* the end surface electrode 312*d* or the end surface electrode 312*e* may be connected to the capacitive electrode, or plural end surface electrodes may also be connected thereto. In this case, impedance matching can also be attained easily.

Moreover, although the first transmission line electrode 304, the second transmission line electrode 306 and the third transmission line electrode 308 are connected to one another via the end surface electrode 312*b* in the present embodiment, these electrodes may be connected by using through holes provided on the side surfaces of a dielectric comprising the dielectric layers. This configuration is effective in reducing external effects.

Although the transmission lines in accordance with the present embodiment can be formed by various methods, the present invention is not limited to details about such methods.

(EMBODIMENT 3)

Figure 5:
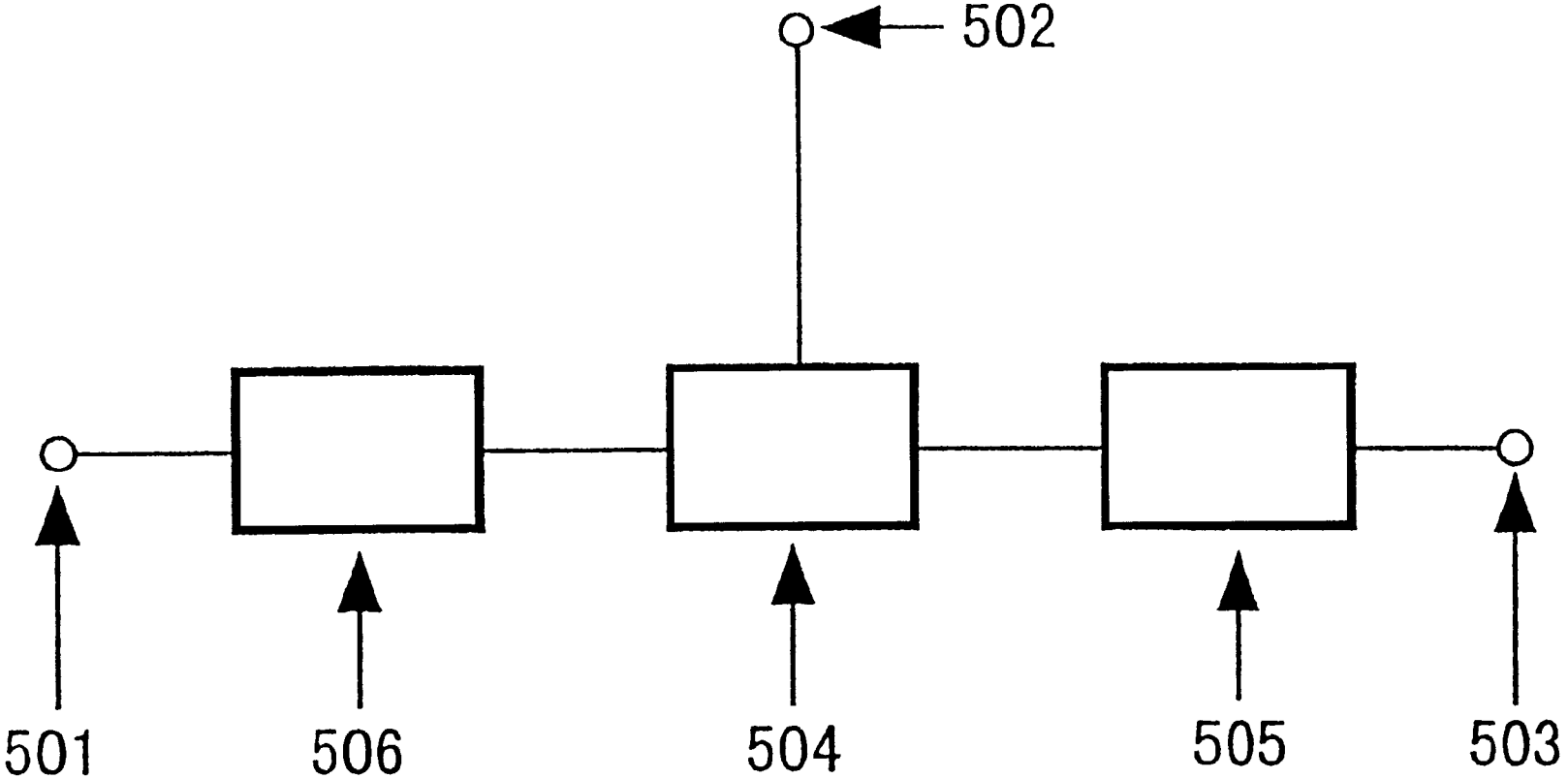
FIG. 5 is a circuit diagram of a duplexer in accordance with embodiment 3 of the present invention.

FIG. 5 shows a duplexer in accordance with embodiment 3 of the present invention. Referring to the figure, the configuration of the present embodiment will be described below. A matching circuit 504 shown in FIG. 5 is formed of the matching circuit chip described in the explanation of embodiment 1 or embodiment 2.

As shown in FIG. 5, one end of a receiving filter 506 is connected to the first filter connection terminal 101 (see FIG. 1A) of the matching circuit chip 504, one end of a transmitting filter 505 is connected to the second filter connection terminal 103 (see FIG. 1A), and the antenna terminal 102 (see FIG. 1A) of the matching circuit chip is directly used as an antenna terminal 502. In this case, the other end of the receiving filter 506 is used as a receiving terminal 501, and the other end of the transmitting filter 505 is used as a transmitting terminal 503.

The operation of the duplexer configured as described above will be described below.

A transmission signal having been input to the transmitting terminal 503 enters the transmitting filter 505. Only the signal components thereof with frequencies within the pass band frequencies of the transmitting filter 505 pass through, and are output from the antenna terminal 502 via the matching circuit chip 504 without being affected by the receiving filter 506. In addition, a reception signal having been input to the antenna terminal 502 is input to the receiving filter 506 via the matching circuit chip 504 without being affected by the transmitting filter 506. Only the signal components thereof with frequencies within the pass band frequencies of the receiving filter 506 pass through, and are output to the receiving terminal 501. As a result, the duplexer can be made far more compact.

Such a duplexer as the present embodiment may also be used for mobile communication apparatuses. In this case, the configuration of the duplexer is effective in making mobile communication apparatuses far more compact.

Although the transmitting filter and the receiving filter of the duplexer in accordance with the present embodiment can be formed by various methods, the duplexer in accordance with the present invention is not limited to details about such methods.

(EMBODIMENT 4)

In the case when a duplexer is configured by using the matching circuit chip described in the explanation of the above-mentioned embodiment, at least three elements 504, 505 and 506 are required as shown in FIG. 5, whereby the cost of production may become higher, and the mounting area for them on a substrate may become larger. An example devised to solve these problems will be described below.

Figure 6A:
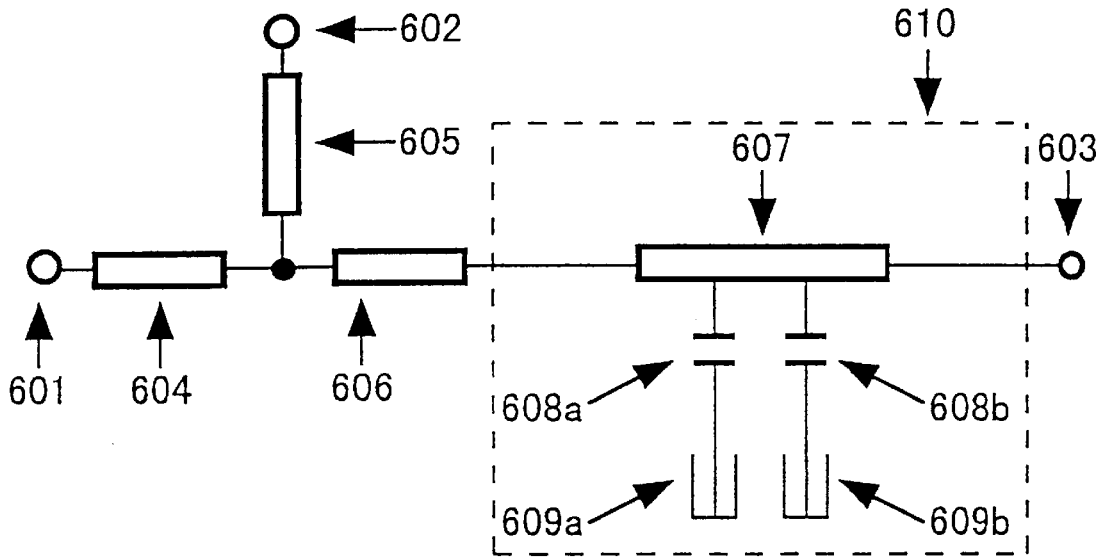
FIG. 6A is a circuit diagram of a filter with a matching circuit in accordance with embodiment 4 of the present invention.

FIG. 6A is a circuit diagram of a filter with a matching circuit in accordance with embodiment 4 of the present invention.

In FIG. 6A, the filter with a matching circuit has a main unit 611 of an integrated shape comprising a first transmission line 604, a second transmission line 605, a third transmission line 606, a transmission line 607 for a transmitting filter, two capacitor elements 608a and 608*b,* and two resonators 609*a* and 609*b*. One end of the first transmission line 604, one end of the second transmission line 605 and one end of the third transmission line 606 are connected to one another. In addition, the transmission line 607 for the transmitting filter is connected to the two resonators 609*a* and 609*b* via capacitor elements 608*a* and 608*b,* respectively. Furthermore, the other end of the third transmission line 606 is connected to one end of the transmission line 607 for the transmitting filter. Moreover, a receiving filter connection terminal 601 is connected to the other end of the first transmission line 604, an antenna terminal 602 is connected to the other end of the second transmission line 605, and a transmitting terminal 603 is connected to the other end of the transmission line 607 for transmitting filter.

Figure 6B:
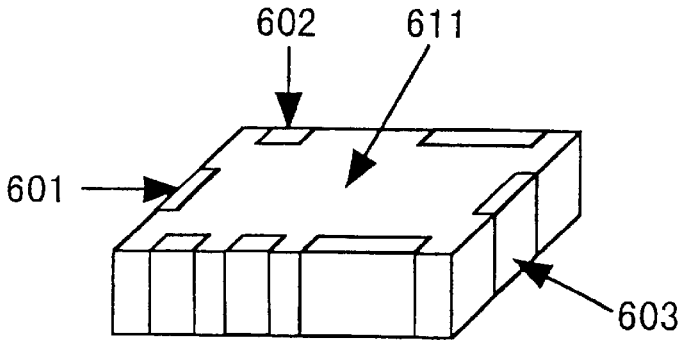
FIG. 6B is a perspective view showing the filter with the matching circuit in accordance with embodiment 4 of the present invention.

FIG. 6B is a perspective view showing the main unit 611 of the filter with the matching circuit in accordance with embodiment 4.

In FIG. 6B, the main unit 611 incorporates the first transmission line 604, the second transmission line 605, the third transmission line 606, the transmission line 607 for the transmitting filter, the two capacitor elements 608*a* and 608*b,* and the two resonators 609*a* and 609*b*. Furthermore, the receiving filter connection terminal 601, the antenna terminal 602 and the transmitting terminal 603 are provided on the side surfaces of the main unit 611.

The first terminal in accordance with the present invention corresponds to the receiving filter connection terminal 601.

The operation of the filter with the matching circuit configured as described above will be described below.

Since the capacitor elements 608*a* and 608*b* are connected in series with the resonators 609*a* and 609*b,* respectively, they operate as two notches wherein the amount of attenuation is high at the resonance frequencies of the resonators 609*a* and 609*b*. Furthermore, by adjusting the connection positions of the capacitor elements 608*a* and 608*b* to the transmission line 607 for the transmitting filter, the transmission line 607 for the transmitting filter, is divided into three portions: a connection element between the two notches, and two connection elements for distributed constant lines on the external sides.

Therefore, the resonators 609*a* and 609*b* are connected in parallel with each other via the capacitor elements 608*a* and 608*b,* respectively, whereby the configuration operates as a notch filter 610 wherein both ends of the transmission line 607 for the transmitting filter are used as input and output terminals.

Furthermore, the third transmission line 606 is set to have a line length equal to nearly one quarter wavelength in the frequency band of an element connected to the receiving filter connection terminal 601, and the first transmission line 604 is set to have a line length equal to nearly one quarter wavelength in the frequency band of the notch filter 610.

It is herein assumed that the impedance at the connection point of the first transmission line 604 and the third transmission line 606 is ZA3, that the impedance at the antenna terminal 602 is ZB2, and that the characteristic impedance of the second transmission line 605 is Z03. By using Equation 3 described below, i. e., a general equation regarding impedance matching, 50 is assigned to ZB3 so that ZB3=50 ohms is obtained in the entire frequency bands of the notch filter 610 and the element connected to the receiving filter connection terminal 601:

$$Z03 \times Z03 = ZA3 \times 50 \quad \text{[Equation 3]}$$

the characteristic impedance Z03 and the line length of the second transmission line 605 are set.

In this case, the second transmission line 605 operates as an impedance converter, and converts the impedance ZA3 at the connection point of the first transmission line 604 and the third transmission line 606 to 50 ohms. As a result, by adjusting the line condition of the second transmission line 605, the impedance matching between the antenna terminal 602 and the notch filter 610 can be attained, and the impedance matching between the antenna terminal 602 and the element connected to the receiving filter connection terminal 601 can be attained, while the degree of freedom of design of the first transmission line 604 and the third transmission line 606 remains unchanged. In this way, the configuration is used as a matching circuit.

With the above-mentioned configuration, the present embodiment operates as a notch filter having a compact matching circuit chip capable of being formed of a simple circuit.

Figure 7:
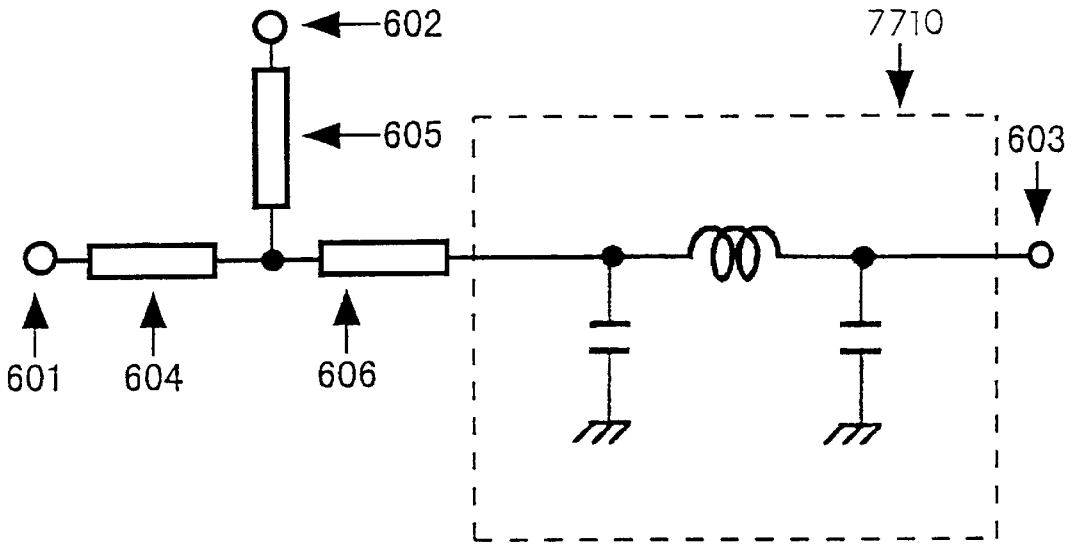
FIG. 7 is a circuit diagram wherein a low-pass filter is used as the transmitting filter in the filter with the matching circuit in accordance with embodiment 4.

The transmitting filter in accordance with the present embodiment may be a low-pass filter 771 shown in FIG. 7. Furthermore, although the low-pass filter can be formed by various methods, the filter in accordance with the present invention is not limited to details about such methods.

Next, a modification example of the above-mentioned embodiment will be described below referring to FIGS. 8A and 8B.

Figure 8A:
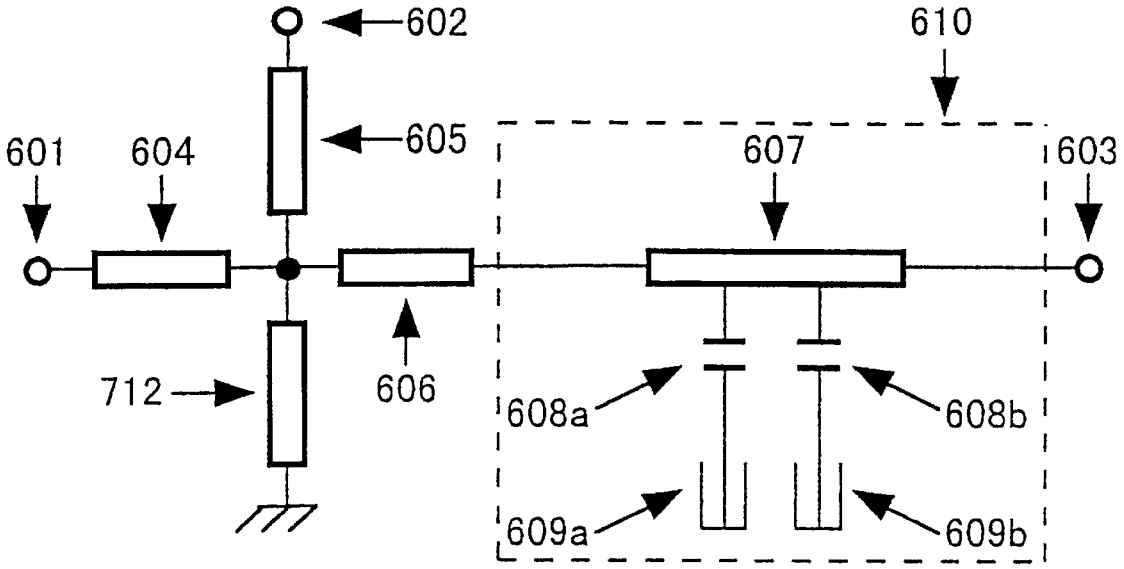
FIG. 8A is a circuit diagram of a filter with a matching circuit in accordance with a modification of embodiment 4 of the present invention.
Figure 8B:
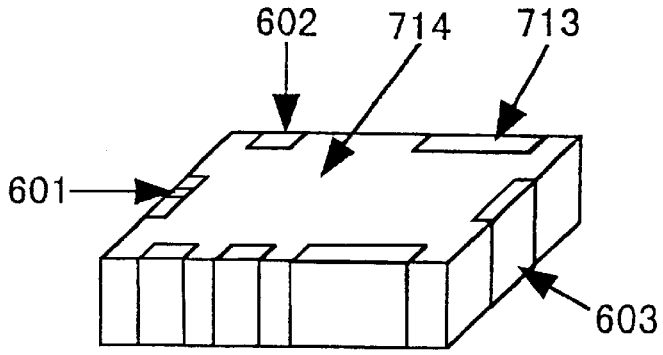
FIG. 8B is a perspective view showing the filter with the matching circuit in accordance with the modification of embodiment 4 of the present invention.

Although the matching circuit portion of the filter with the matching circuit in accordance with the above-mentioned embodiment comprises three transmission lines, it is possible to have a configuration wherein one end of a fourth transmission line 712 is connected to the connection point of the first, second and third transmission lines as shown in FIG. 8A, and the other end thereof is grounded via a ground terminal 713 provided on a side surface of the main unit 714 of the modification example as shown in FIG. 8B.

This configuration is effective in reducing a load to the second transmission line 605 and in attaining impedance matching in a wide frequency range because of the same reason as that described in the explanation of the modified example of the above-mentioned embodiment 1.

Although the transmission lines, capacitor elements and resonators in accordance with the present embodiment can be formed by various methods, the present invention is not limited to details about such methods.

(EMBODIMENT 5)

Figure 9:
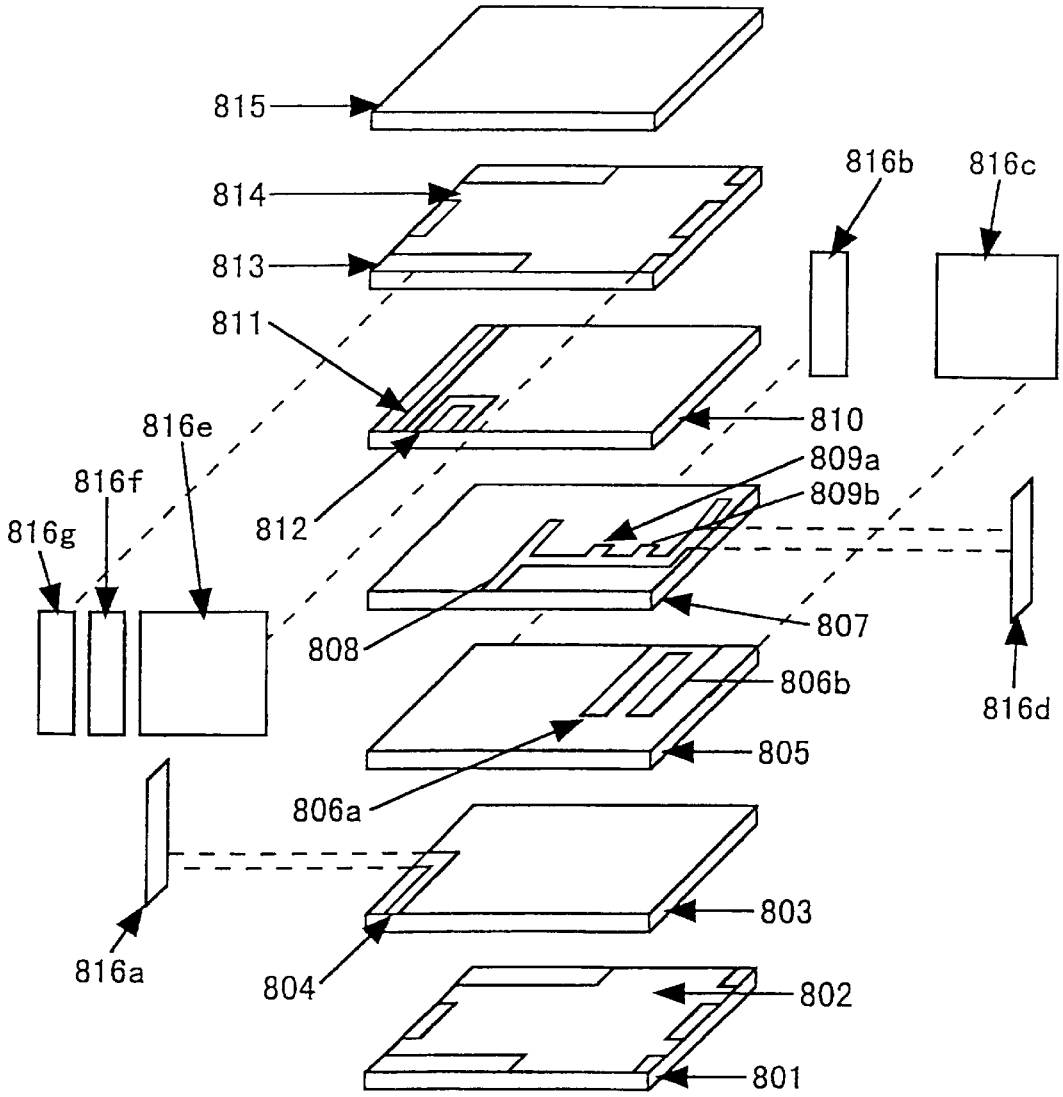
FIG. 9 is a perspective view showing a filter with a matching circuit in accordance with embodiment 5 of the present invention.

FIG. 9 shows a filter with a matching circuit in accordance with embodiment 5 of the present invention.

As shown in FIG. 9, a first shield electrode 802 is disposed on the upper surface of a first dielectric layer 801, and a second dielectric layer 803 is laid (laminated) on the first shield electrode 802. In addition, a first transmission line electrode 804 is disposed on the upper surface of the dielectric layer 803, a third dielectric layer 805 is laid on the first transmission line electrode 804, and two resonator electrodes 806*a* and 806*b* are disposed on the upper surface of the dielectric layer 805. Furthermore, a fourth dielectric layer 807 is laid on the resonator electrodes 806*a* and 806*b*, and a transmission line electrode 808 for a transmitting filter and two capacitor electrodes 809*a* and 809*b* are disposed on the upper surface of the fourth electrode layer 807. Moreover, a fifth dielectric layer 810 is laid on the transmission line electrode 808 and the two capacitor electrodes 809*a* and 809*b*, and a second transmission line electrode 811 and a third transmission line electrode 812 are disposed on the upper surface of the fifth dielectric layer 810. Additionally, a sixth dielectric layer 813 is laid on the electrodes 811 and 812, a second shield electrode 814 is disposed on the upper surface of the sixth dielectric layer 813, and a seventh dielectric layer 815 is laid on the electrode 814. Besides, seven end surface electrodes 816 are provided on the side surfaces of a dielectric comprising the dielectric layers, the first transmission line electrode 804 is connected to an end surface electrode 816*a*, and the second transmission line electrode 811 is connected to an end surface electrode 816*b*. Furthermore, the first shield electrode 802, the resonator electrodes 806*a* and 806*b*, the second shield electrode 814 and an end surface electrode 816*c* are connected to one another and grounded. Moreover, the transmission line electrode 808 for the transmitting filter is connected to an end surface electrode 816*d*, and the first shield electrode 802, the second shield electrode 814 and an end surface electrode 816e are connected to one another and grounded. Additionally, the transmission line electrode 808 for the transmitting filter, the third transmission line electrode 812 and an end surface electrode 816*f* are connected to one another, and the first transmission line electrode 804, the second transmission line electrode 811 and the third transmission line electrode 812 are connected to one another via an end surface electrode 816*g*.

The operation of the filter with the matching circuit configured as described above will be described below.

Since the operation of the filter with the matching circuit in accordance with the present embodiment is basically the same as that of the filter with the matching circuit described in the explanation of embodiment 4, the operation is not described in detail.

Since the resonator electrodes 806*a* and 806*b* are grounded via the end surface electrode 816*c*, they form a quarter-wave resonator. The capacitor electrodes 809*a* and 809*b*, connected to the transmission line electrode 808 for the transmitting filter, are disposed to face the open ends of the resonator electrodes 806*a* and 806*b*, respectively, to form notch capacitances, thereby operating as two notches having high attenuation amounts at the resonance frequencies of the resonators. In addition, by adjusting the connection position of the capacitor electrodes 809*a* and 809*b* to the transmission line electrode 808 for the transmitting filter, the transmission line electrode 808 for the transmitting filter is divided into three portions: a connection element between the two notches, and two connection elements for distributed constant lines on the external sides. Therefore, the resonator electrodes 806*a* and 806*b* are connected in parallel with each other via the capacitor electrodes 809*a* and 809*b*, respectively, whereby this configuration operates as a notch filter wherein both ends of the transmission line electrode 808 for the transmitting filter are used as input and output terminals.

The length of the third transmission line electrode 812 is set at nearly one quarter wavelength in the frequency band of an element connected to the end surface electrode 816*a*, and the length of the first transmission line electrode 804 is set at nearly one quarter wavelength in the frequency band of a notch filter comprising the resonator electrodes 806*a* and 806*b*, the transmission line electrode 808 for the transmitting filter and the capacitor electrodes 809*a* and 809*b*. In addition, it is assumed that the impedance at the end surface electrode 816*b* is Zb4, that the impedance at the end surface electrode 816*g* is Zg4, and that the characteristic impedance of the second transmission line electrode 811 is Z04. By using Equation 4 described below, i. e., a general equation regarding impedance matching, 50 is assigned to Zb4 so that Zb4=50 ohms is obtained in the entire frequency bands of elements connected to the notch filter and the end surface electrode 816*a*:

$$Z04 \times Z04 = Zg4 \times 50 \qquad \text{[Equation 4]}$$

the characteristic impedance Z04 and the line length of the second transmission line electrode 811 are set.

In this case, the second transmission line electrode 811 operates as an impedance converter, and converts the impedance Zg4 of the end surface electrode 816*g* to 50 ohms. As a result, by adjusting the line condition of the second transmission line electrode 811, the impedance matching between the notch filter and the end surface electrode 816*b* can be attained, and the impedance matching between the element connected to the end surface electrode 816*a* and the end surface electrode 816*b* can be attained, while the degree of freedom of design of the first transmission line electrode 804 and the third transmission line electrode 816*b* remains unchanged.

Therefore, in the present embodiment, the end surface electrode 816*a* is used as a receiving filter connection terminal, the end surface electrode 816*b* is used as an antenna terminal, and the end surface electrode 816*d* is used as a transmitting terminal, whereby this configuration operates as a filter with a compact matching circuit capable of being formed of a simple circuit.

The shield electrodes in accordance with the present embodiment are two layers: the first shield electrode 802 and the second shield electrode 814. However, the present embodiment is not limited to this configuration, and a configuration shown in FIG. 10 may be used.

Figure 10:
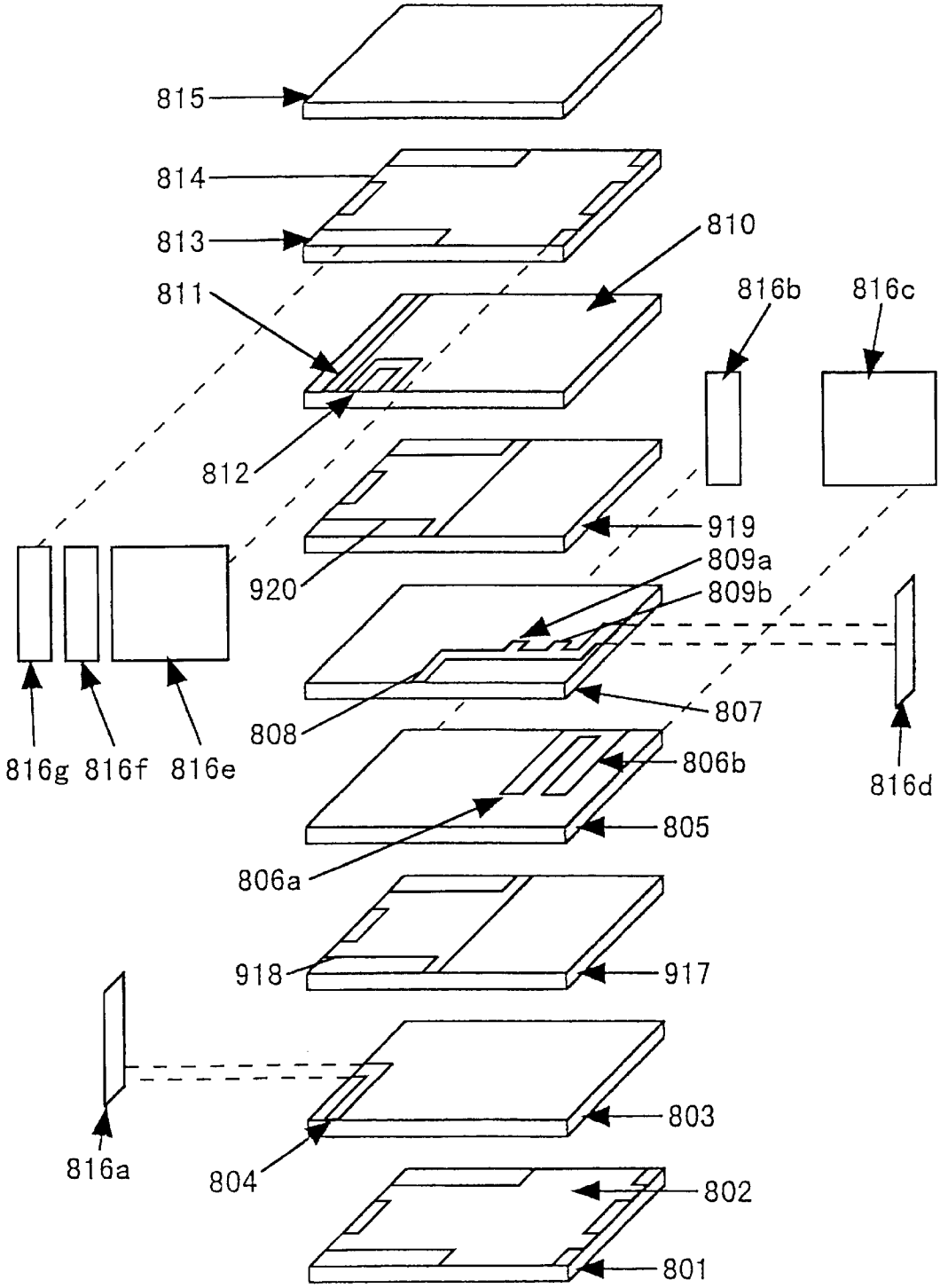
FIG. 10 is a perspective view showing another configuration of the filter with the matching circuit in accordance with embodiment 5 of the present invention.

In other words, in FIG. 10, an eighth dielectric layer 917 is laid on the first transmission line electrode 804, and a third shield electrode 918 is disposed on the upper surface of the dielectric layer 917, and the third dielectric layer 805 is laid on the electrode 918.

Furthermore, a ninth dielectric layer 919 is laid on the transmission line electrode 808 for the transmitting filter and the two capacitor electrodes 809*a* and 809*b* which are disposed on the fourth dielectric layer 807, a fourth shield electrode 920 is disposed on the upper surface of the dielectric layer 919, and the fifth dielectric layer 810 is laid on the electrode 920.

In this case, the first transmission line electrode 804 is separated from the resonator electrodes 806*a* and 806*b*, the transmission line electrode 808 for the transmitting filter and the capacitor electrodes 809*a* and 809*b* by the shield electrode 918. Furthermore, the resonator electrodes 806*a* and 806*b*, the transmission line electrode 808 for the transmitting filter and the capacitor electrodes 809*a* and 809*b* are also separated from the second transmission line electrode 811 and the third transmission line electrode 812 by the shield electrode 920. Therefore, unnecessary electromagnetic coupling among the three sets of electrodes is eliminated, thereby being effective in accurately achieving a filter with a matching circuit.

In addition, the third shield electrode 918 and the fourth shield electrode 920 each have a size for covering only the matching circuit portion in order to maintain the characteristic impedances of the resonators high. However, the size may be the same as those of the first shield electrode 802 and the second shield electrode 814. In this case, unnecessary electromagnetic coupling among the three sets of electrodes is more eliminated, thereby being effective in accurately achieving a filter with a matching circuit.

In addition, a capacitive electrode may be provided in the dielectric layers of the present embodiment, and connected to the end surface electrode 816*d*, for example, to form a capacitor between the end surface electrode 816*d* and the ground. This configuration is effective in easily attaining impedance matching for the notch filter. Furthermore, the capacitive electrode may be connected to the end surface electrode 816*f*, for example, to form a capacitor between the end surface electrode 816*f* and the ground. This configuration is effective in more easily attaining impedance matching for the matching circuit.

Furthermore, the end surface electrode 816*a*, the end surface electrode 816*b* or the end surface electrode 816*g* may connected to the capacitive electrode, or plural end surface electrodes may also be connected thereto. In this case, impedance matching can also be attained easily.

Moreover, a short stub line electrode may be provided in the dielectric layers of the present embodiment, and connected to the end surface electrode 816*f*, for example, to form a half-wave stub line. In this case, by adjusting the length of the line, an attenuation pole is formed in the harmonic band of the notch filter, thereby being effective in increasing the amount of attenuation.

Besides, the end surface electrode 816*b*, the end surface electrode 816*d* or the end surface electrode 816*g* may be connected to the short stub line electrode, or plural end surface electrodes may also be connected thereto. In this case, an attenuation pole is also formed in the harmonic band of the notch filter, thereby being effective in increasing the amount of attenuation.

Additionally, the short stub line electrode may also be an open stub electrode. In this case, the stub line electrode becomes a quarter-wave stub line and offers a similar action, thereby being effective in reducing the area of the electrode.

Furthermore, when an attenuation pole is formed in the harmonic band by using the stub line, the attenuation pole acts as a capacitance near the pass band of the notch filter, thereby being effective in easily attaining impedance matching.

Moreover, although the electrodes in accordance with the present embodiment are connected to one another via the end surface electrodes provided on the side surfaces of a dielectric comprising the dielectric layers, the electrodes may be connected by using through holes formed in the dielectric. This configuration is effective in reducing external effects.

Although the transmission lines in accordance with the present embodiment can be formed by various methods, the present invention is not limited to details about such methods.

In addition, although various materials can be used for electrode materials and dielectric materials in accordance with the present embodiment, the present invention is not limited to those materials.

(EMBODIMENT 6)

Figure 11:
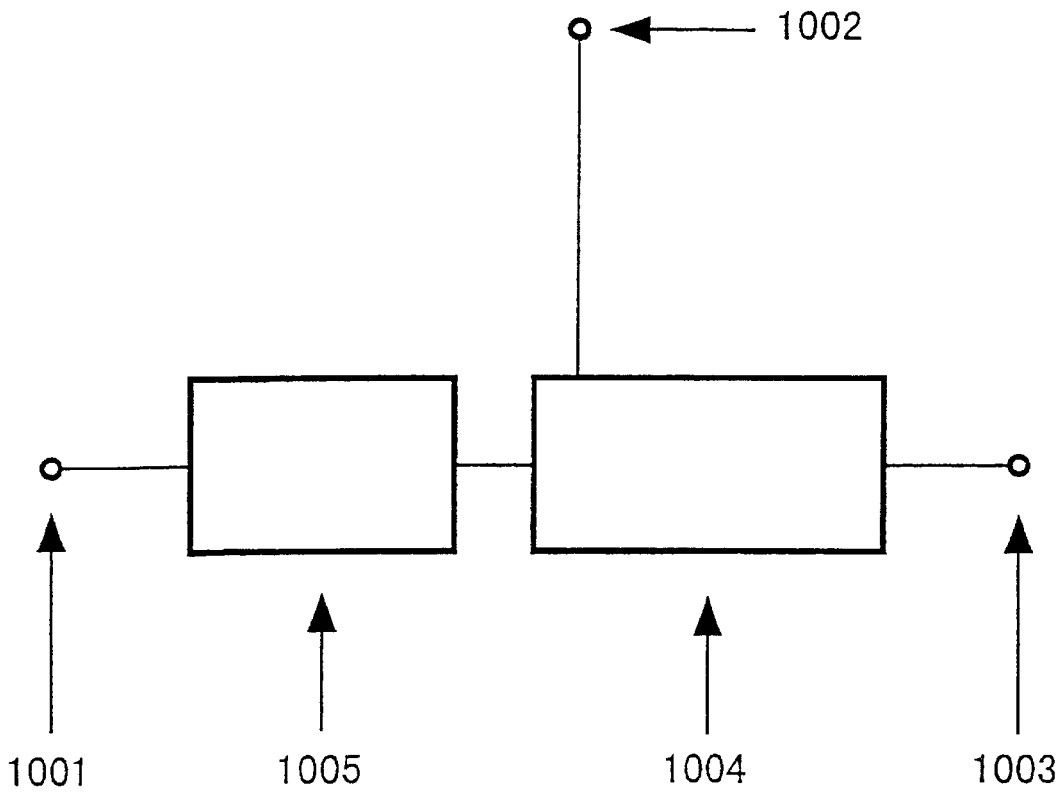
FIG. 11 is a circuit diagram of a duplexer in accordance with embodiment 6 of the present invention.

FIG. 11 shows a duplexer in accordance with embodiment 6 of the present invention. Referring to the figure, the configuration of the present embodiment will be described below. The filter with the matching circuit described in the explanation of embodiment 4 or embodiment 5 is used as a filter 1004 with a matching circuit shown in FIG. 11.

As shown in FIG. 11, one end of a receiving filter 1005 is connected to the receiving filter connection terminal 601 (see FIG. 6A) of the filter 1004 with the matching circuit, and the antenna terminal 602 (see FIG. 6A) of the filter with the matching circuit is directly used as an antenna terminal 1002. With this configuration, the transmitting terminal 603 of the filter with the matching circuit is directly used as a transmitting terminal 1003, and the other end of the receiving filter 1005 is used as a receiving terminal 1001.

The operation of the duplexer configured as described above will be described below.

A transmission signal having been input to the transmitting terminal 1003 enters a notch filter in the filter 1004 with the matching circuit. Only the signal components thereof with frequencies within the pass band frequencies of the filter pass through, and are output from the antenna terminal 1002 via the matching circuit in the filter 1004 with the matching circuit without being affected by the receiving filter 1001. In addition, a reception signal having been input to the antenna terminal 1002 is input to the receiving filter 1005 via the matching circuit in the filter 1004 with the matching circuit without being affected by the notch filter in the filter 1004 with the matching circuit. Only the signal components thereof with frequencies within the pass band frequencies of the receiving filter 1005 pass through, and are output to the receiving terminal 1001. This configuration thus operates as a duplexer.

Figure 21:
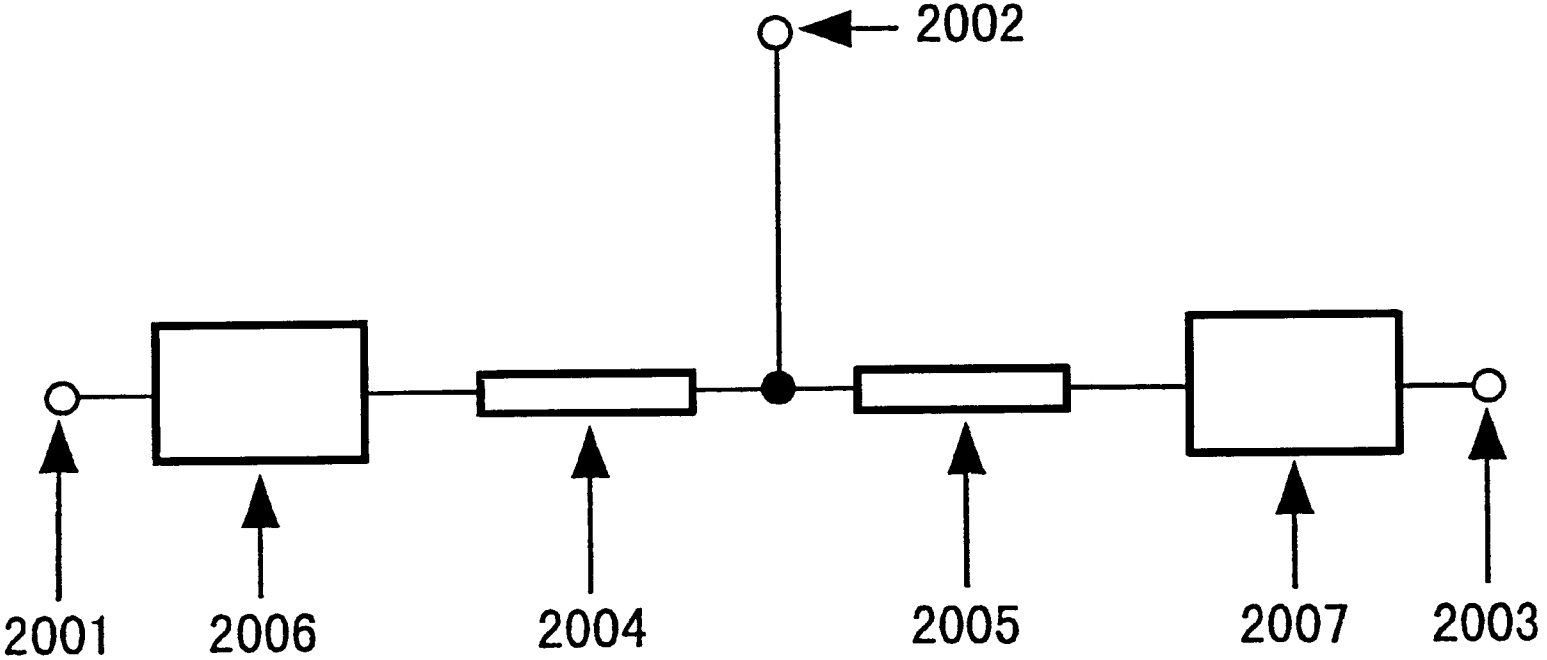
FIG. 21 is a circuit diagram of a conventional duplexer.

As a result, the transmitting filter 2007 (see FIG. 21) is unnecessary, and the duplexer can be made far more compact.

Such a duplexer as the present embodiment may also be used for mobile communication apparatuses. In this case, the configuration of the duplexer is effective in making mobile communication apparatuses far more compact.

Although the receiving filter of the duplexer in accordance with the present embodiment can be formed by various methods, the duplexer in accordance with the present invention is not limited to details about such methods.

(EMBODIMENT 7)

Figure 12A:
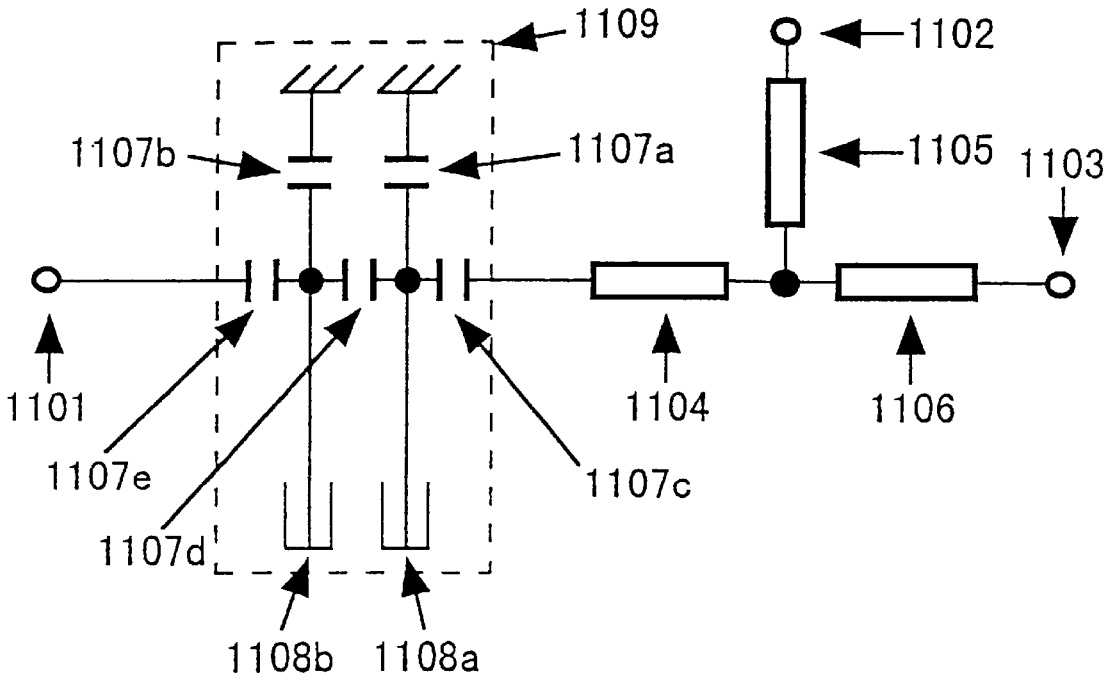
FIG. 12A is a circuit diagram of a filter with a matching circuit in accordance with embodiment 7 of the present invention.

FIG. 12A is a circuit diagram of a filter with a matching circuit in accordance with embodiment 7 of the present invention.

As shown in FIG. 12A, the filter with the matching circuit has a main unit 1110 of an integrated shape comprising a first transmission line 1104, a second transmission line 1105, a third transmission line 1106, five capacitor elements 1107*a*, 1107*b*, 1107*c*, 1107*d* and 1107*e*, and two resonators 1108*a* and 1108*b*. One end of the first transmission line 1104, one end of the second transmission line 1105 and one end of the third transmission line 1106 are connected to one another. Furthermore, the other end of the first transmission line 1104 is connected to the resonator 1108*a* via the capacitor element 1107*c*, the resonator 1108*a* is connected to the resonator 1108*b* via the capacitor element 1107*d*, and the resonator 1108*b* is connected to a receiving terminal 1101 via the capacitor element 1107*e*. Moreover, the capacitor elements 1107*a* and 1107*b* are connected to the open ends of the resonators 1108*a* and 1108*b*, respectively, and grounded. Additionally, an antenna terminal 1102 is connected to the other end of the second transmission line 1105, and a transmitting filter connection terminal 1103 is connected to the other end of the third transmission line 1106.

Figure 12B:
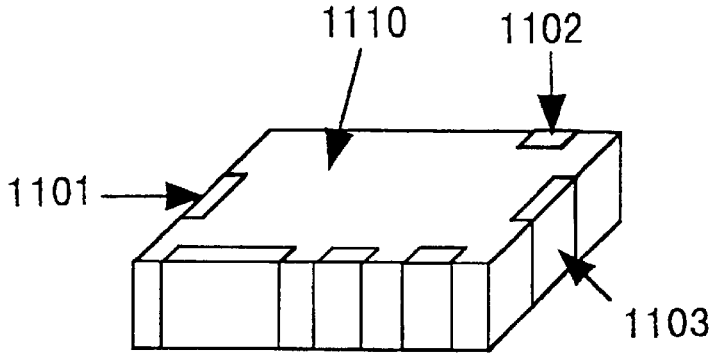
FIG. 12B is a perspective view showing the filter with the matching circuit in accordance with embodiment 7 of the present invention.

FIG. 12B is a perspective view showing the main unit 1110 of the filter with the matching circuit in accordance with embodiment 7. In FIG. 12B, the main unit 1110 incorporates the first transmission line 1104, the second transmission line 1105, the third transmission line 1106, the five capacitor elements 1107*a*, 1107*b*, 1107*c*, 1107*d* and 1107*e*, and the two resonators 1108*a* and 1108*b*. In addition, the main unit 1110 is provided with the receiving terminal 1101, the antenna terminal 1102 and the transmitting filter connection terminal 1103 on the side surfaces thereof. The second terminal in accordance with the present invention corresponds to the transmitting filter connection terminal.

The operation of the filter with the matching circuit configured as described above will be described below.

The capacitor elements 1107*a* and 1107*b* operate as load capacitors for the resonators 1108*a* and 1108*b*, respectively, to adjust the resonance frequencies of the resonators. In addition, the capacitor element 1107*d* operates as a capacitor for interstage coupling between the resonator 1108*a* and the resonator 1108*b*, and the capacitor elements 1107*c* and 1107*e* operate as input/output coupling capacitors. As a result, this configuration operates as a band pass filter 1109 having the capacitor elements 1107*c* and 1107*e* as input and output terminals, respectively.

The third transmission line 1106 is set to have a line length equal to nearly one quarter wavelength in the frequency band of the band pass filter 1109, and the first transmission line 1104 is set to have a line length equal to nearly one quarter wavelength in the frequency band of an element connected to the transmitting filter connection terminal 1103. It is herein assumed that the impedance at the connection point of the first transmission line 1104 and the third transmission line 1106 is ZA5, that the impedance at the antenna terminal 1102 is ZB5, and that the characteristic impedance of the second transmission line 1105 is Z05. By using Equation 5 described below, i. e., a general equation regarding impedance matching, 50 is assigned to ZB5 so that ZB5=50 ohms is obtained in the entire frequency bands of the element connected to the transmitting filter connection terminal 1103 and the band pass filter 1109:

$$Z05 \times Z05 = ZA5 \times 50 \qquad \text{[Equation 5]}$$

the characteristic impedance Z05 and the line length of the second transmission line 1105 are set.

In this case, the second transmission line 1105 operates as an impedance converter, and converts the impedance ZA5 at the connection point of the first transmission line 1104 and the third transmission line 1106 to 50 ohms. As a result, by adjusting the line condition of the second transmission line 1105, the impedance matching between the antenna terminal 1102 and the element connected to the transmitting filter connection terminal 1103 can be attained, and the impedance matching between the antenna terminal 1102 and the band pass filter 1109 can be attained, while the degree of freedom of design of the first transmission line 1104 and the third transmission line 1106 remains unchanged. In this way, the configuration operates as a matching circuit capable of attaining impedance matching.

With the above-mentioned configuration, the present embodiment operates as a compact band pass filter with a matching circuit capable of being formed of a simple circuit.

Next, a modification example of the above-mentioned embodiment will be described below referring to figures.

Figure 13A:
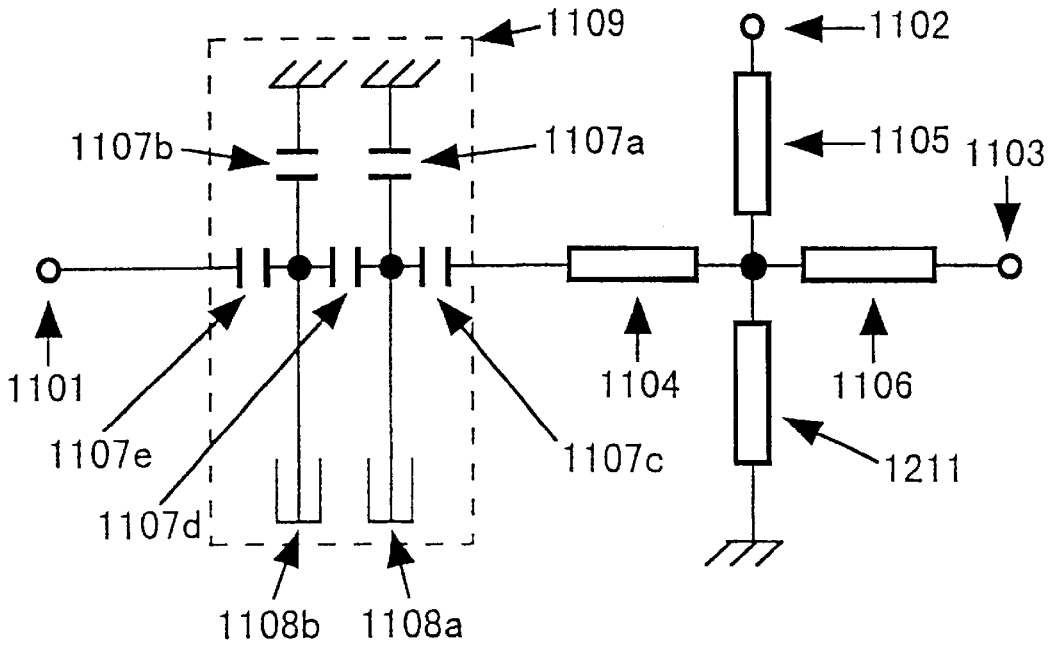
FIG. 13A is a circuit diagram of a filter with a matching circuit in accordance with a modification of embodiment 7 of the present invention.
Figure 13B:
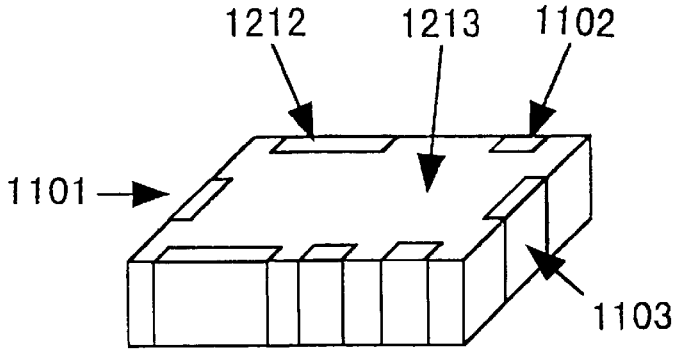
FIG. 13B is a perspective view showing the filter with the matching circuit in accordance with the modification of embodiment 7 of the present invention.

Although the matching circuit portion of the filter with the matching circuit in accordance with the above-mentioned embodiment comprises three transmission lines, it is possible to have a configuration wherein one end of a fourth transmission line 1211 is connected to the connection point of the first transmission line 1104, the second transmission line 1105 and the third transmission line 1106 as shown in FIG. 13A, and the other end thereof is grounded via a ground terminal 1212 provided on a side surface of a main unit 1213 of the modification example as shown in FIG. 13B.

This configuration is effective in reducing a load to the second transmission line 1105 and in attaining impedance matching in a wider frequency range.

Although the transmission lines, capacitor elements and resonators in accordance with the present embodiment can be formed by various methods, the present invention is not limited to details about such methods.

(EMBODIMENT 8)

Figure 14:
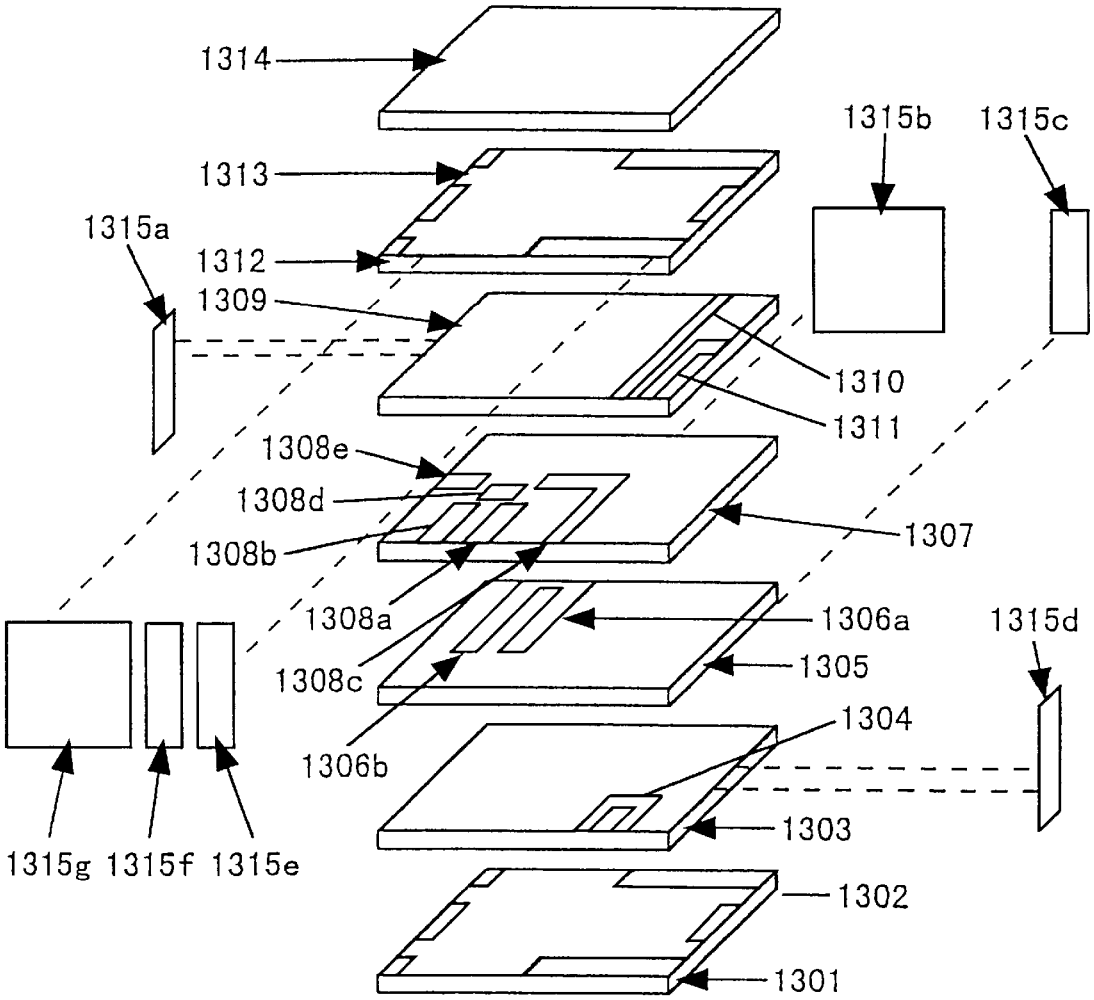
FIG. 14 is a perspective view showing a filter with a matching circuit in accordance with embodiment 8 of the present invention.

FIG. 14 shows a filter with a matching circuit in accordance with embodiment 8 of the present invention.

As shown in FIG. 14, a first shield electrode 1302 is disposed on the upper surface of a first dielectric layer 1301, a second dielectric layer 1303 is laid on the electrode 1302, and a first transmission line electrode 1304 is disposed on the upper surface of the dielectric layer 1303. In addition, a third dielectric layer 1305 is laid on the electrode 1304, and two resonator electrodes 1306*a* and 1306*b* are disposed on the upper surface of the dielectric layer 1305. Furthermore, a fourth dielectric layer 1307 is laid (laminated) on the electrodes 1306*a* and 1306*b*, and five capacitor electrodes 1308*a*, 1308*b*, 1308*c*, 1308*d* and 1308*e* are disposed on the upper surface of the dielectric layer 1307. Moreover, a fifth dielectric layer 1309 is laid on the capacitor electrodes 1308*a*, 1308*b*, 1308*c*, 1308*d* and 1308*e*, a second transmission line electrode 1310 and a third transmission line electrode 1311 are disposed on the upper surface of the fifth dielectric layer 1309. Besides, a sixth dielectric layer 1312 is laid on the electrodes 1310 and 1311, a second shield electrode 1313 is disposed on the upper surface of the dielectric layer 1312, and a seventh dielectric layer 1314 is laid on the electrode 1313. Additionally, seven end surface electrodes 1315 are provided on the side surfaces of a dielectric comprising the dielectric layers, and the capacitor electrode 1308*e* is connected to an end surface electrode 1315*a*. Furthermore, the first shield electrode 1302, the resonator electrodes 1306*a* and 1306*b*, the second shield electrode 1313 and an end surface electrode 1315*b* are connected to one another and grounded. Moreover, the second transmission line electrode 1310 is connected to an end surface electrode 1315*c*, and the third transmission line electrode 1311 is connected to an end surface electrode 1315*d*. Besides, the first transmission line electrode 1304, the second transmission line electrode 1310, the third transmission line electrode 1311 and an end surface electrode 1315*e* are connected to one another. Additionally, the capacitor electrode 1308*c*, the first transmission line electrode 1304 and an end surface electrode 1315*f* are connected to one another, and the first shield electrode 1302, the capacitor electrodes 1308*a* and 1308*b* and the second shield electrode 1313 are connected to one another and grounded via an end surface electrode 1315*g*.

The operation of the filter with the matching circuit configured as described above will be described below.

Since the operation of the filter of the matching circuit in accordance with the present embodiment is basically the same as the filter with the matching circuit described in the explanation of embodiment 7, the present embodiment is not described in detail.

Since one end of the resonator electrode 1306*a* and one end of 1306*b* are grounded via the end surface electrode 1315*b*, this configuration operates as a quarter wave resonator. Since the capacitor electrodes 1308*a* and 1308*b* are disposed facing the open ends of the resonator electrodes 1306*a* and 1306*b*, respectively, they operate as load capacitors and adjust the resonance frequencies of the resonators. In addition, since the capacitor electrode 1308*d* is disposed facing a part of the resonator electrode 1306*a* and a part of the resonator electrode 1306*b*, it operates as an interstage coupling capacitor between the two resonators. Since the capacitor electrode 1308*c* is disposed facing a part of the resonator electrode 1306*a*, and the capacitor electrode 1308*e* is disposed facing a part of the resonator electrode 1306*b*, they operate as input and output coupling capacitors. Therefore, this configuration operates as a band pass filter of a capacitive coupling type wherein the capacitor electrode 1308*c* and the capacitor electrode 1308*e* are used as an input terminal and an output terminal, respectively.

The length of the third transmission line electrode 1311 is set at nearly one quarter wavelength in the frequency band of the band pass filter comprising the resonator electrodes 1306*a* and 1306*b*, the capacitor electrodes 1308*a*, 1308*b*, 1308*c*, 1308*d* and 1308*e*, and the length of the first transmission line electrode 1304 is set at nearly one quarter wavelength in the frequency band of an element connected to the end surface electrode 1315*d*. In addition, it is assumed that the impedance at the end surface electrode 1315*c* is Zc6, that the impedance at the end surface electrode 1315*e* is Ze6, and that the characteristic impedance of the second transmission line electrode 1310 is Z06. By using Equation 6 described below, i. e., a general equation regarding impedance matching, 50 is assigned to Zc6 so that Zc6=50 ohms is obtained in the entire frequency bands of the element connected to the end surface electrode 1315*d* and the band pass filter:

$$Z06 \times Z06 = Ze6 \times 50 \quad \text{[Equation 6]}$$

the characteristic impedance Z06 and the line length of the second transmission line electrode 1310 are set.

In this case, the second transmission line electrode 1310 operates as an impedance converter, and converts the impedance Ze6 of the end surface electrode 1315*e* to 50 ohms. As a result, by adjusting the line condition of the second transmission line electrode 1310, the impedance matching between the element connected to the end surface electrode 1315*d* and the end surface electrode 1315*c* can be attained, and the impedance matching between the band pass filter and the end surface electrode 1315*c* can be attained, while the degree of freedom of design of the first transmission line electrode 1304 and the third transmission line electrode 1311 remains unchanged. This configuration thus operates as a matching circuit.

Therefore, in the present embodiment, the end surface electrode 1315*a* is used as a receiving terminal, the end surface electrode 1315*c* is used as an antenna terminal, and the end surface electrode 1315*d* is used as a transmitting filter connection terminal, whereby this configuration operates as a filter with a compact matching circuit capable of being formed of a simple circuit.

The shield electrodes in accordance with the present embodiment are two layers: the first shield electrode 1302 and the second shield electrode 1313. However, the present embodiment is not limited to this configuration, and a configuration shown in FIG. 15 may be used.

Figure 15:
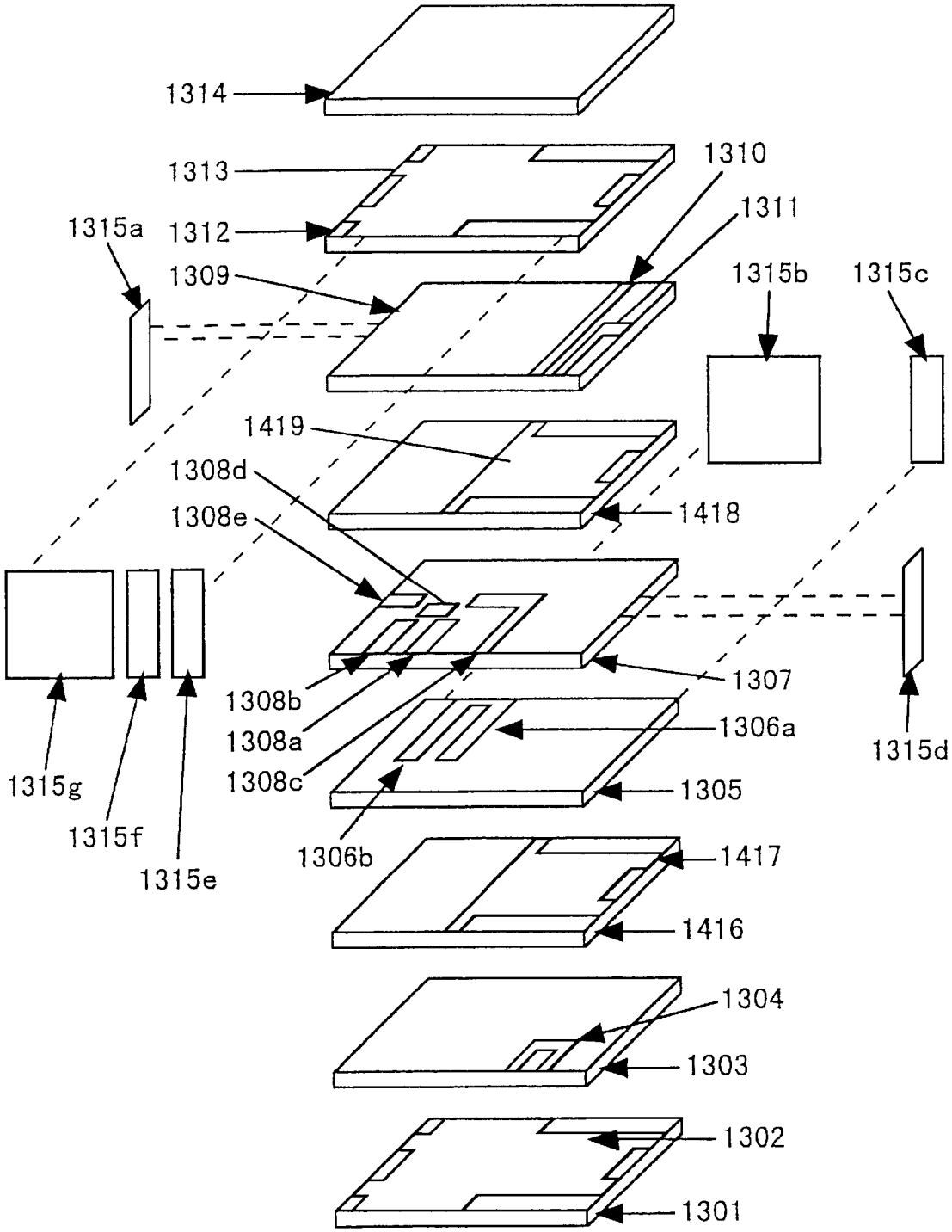
FIG. 15 is a perspective view showing another configuration of the filter with the matching circuit in accordance with embodiment 8 of the present invention.

In other words, as shown in FIG. 15, an eighth dielectric layer 1416 is laid on the first transmission line electrode 1304 disposed on the second dielectric layer 1303, a third shield electrode 1417 is disposed on the upper surface of the dielectric layer 1416, and the third dielectric layer 1305 is laid on the electrode 1417. Furthermore, a ninth dielectric layer 1418 is laid on the capacitor electrodes 1308*a*, 1308*b*, 1308*c*, 1308*d* and 1308*e* disposed on the fourth dielectric layer 1307, a fourth shield electrode 1419 is disposed on the upper surface of the dielectric layer 1418, and a fifth dielectric layer 1309 is laid on the electrode 1419.

In this case, the first transmission line electrode 1304 is separated from the resonator electrodes 1306*a* and 1306*b* and the capacitor electrodes 1308*a*, 1308*b*, 1308*c*, 1308*d* and 1308*e* by the shield electrode 1417. Furthermore the resonator electrodes 1306*a* and 1306*b* and the capacitor electrodes 1308*a*, 1308*b*, 1308*c*, 1308*d* and 1308*e* are separated from the second transmission line electrode 1310 and the third transmission line electrode 1311 by the shield electrode 1418. Therefore, electromagnetic coupling among the three sets of electrodes is eliminated, thereby being effective in accurately achieving a filter with a matching circuit.

In addition, the third shield electrode 1417 and the fourth shield electrode 1419 each have a size for covering only the matching circuit portion in order to maintain the characteristic impedances of the resonators high. However, the size may be the same as those of the first shield electrode 1302 and the second shield electrode 1313. In this case, unnecessary electromagnetic coupling among the three sets of electrodes is more eliminated, thereby being effective in accurately achieving a filter with a matching circuit.

In addition, a capacitive electrode may be provided in the dielectric layers of the present embodiment, and connected to the end surface electrode 1315*d*, for example, to form a capacitor between the end surface electrode 1315*d* and the ground. This configuration is effective in easily attaining impedance matching for the element connected to the end surface electrode 1315*d*. Furthermore, the capacitive electrode may be connected to the end surface electrode 1315*f*, for example, to form a capacitor between the end surface electrode 1315*f* and the ground. This configuration is effective in more easily attaining impedance matching for the matching circuit.

Furthermore, the end surface electrode 1315*a*, the end surface electrode 1315*c* or the end surface electrode 1315*e* may be connected to the capacitive electrode, or plural end surface electrodes may also be connected thereto. In this case, impedance matching can also be attained easily.

Moreover, a short stub line electrode may be provided in the dielectric layers of the present embodiment, and connected to the end surface electrode 1315*f*, for example, to form a half-wave stub line. In this case, by adjusting the length of the line, an attenuation pole is formed in the harmonic band of the band pass filter, thereby being effective in increasing the amount of attenuation.

Besides, the end surface electrode 1315*a*, the end surface electrode 1315*c* or the end surface electrode 1315*e* may be connected to the short stub line electrode, or plural end surface electrodes may also be connected thereto. In this case, an attenuation pole is also formed in the harmonic band of the notch filter, thereby being effective in increasing the amount of attenuation.

Additionally, the short stub line electrode may be used as an open stub electrode. In this case, the stub line electrode becomes a quarter-wave stub line and offers a similar action, thereby being effective in reducing the area of the electrode.

Furthermore, when an attenuation pole is formed in the harmonic band by using the stub line, the attenuation pole acts as a capacitance near the pass band of the band pass filter, thereby being effective in easily attaining impedance matching.

Moreover, although the electrodes in accordance with the present embodiment are connected to one another via the end surface electrodes provided on the side surfaces of a dielectric comprising the dielectric layers, the electrodes may be connected by using through holes formed in the dielectric. This configuration is effective in reducing external effects.

Although the transmission lines in accordance with the present embodiment can be formed by various methods, the present invention is not limited to details about such methods.

In addition, although various materials can be used for electrode materials and dielectric materials in accordance with the present embodiment, the present invention is not limited to those materials.

(EMBODIMENT 9)

Figure 16:
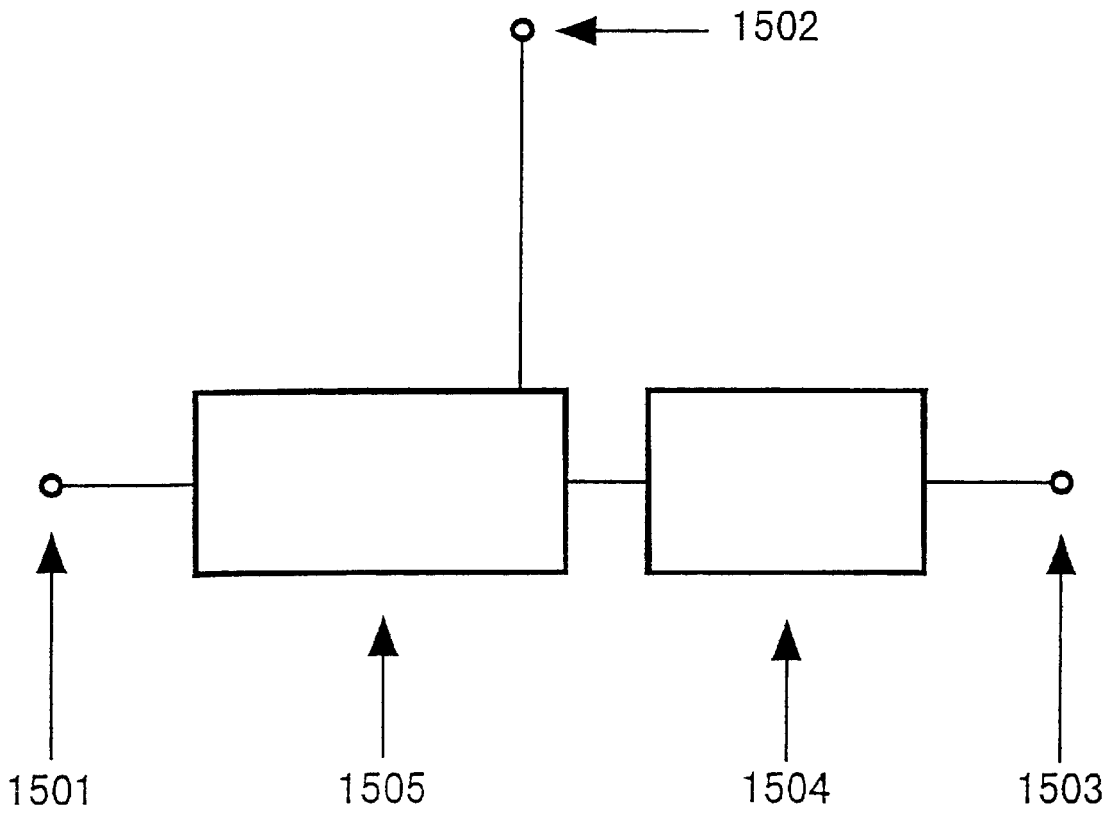
FIG. 16 is a circuit diagram of a duplexer in accordance with embodiment 9 of the present invention.

FIG. 16 shows a duplexer in accordance with embodiment 9 of the present invention. Referring to the figure, the configuration of the present embodiment will be described below. The filter with the matching circuit described in the explanation of embodiment 7 or embodiment 8 is used as a filter 1505 with a matching circuit shown in FIG. 16.

As shown in FIG. 16, one end of a transmitting filter 1504 is connected to the transmitting filter connection terminal 1103 (see FIG. 12A) of the filter 1505 with the matching circuit, and the antenna terminal 1102 (see FIG. 12A) of the filter with the matching circuit is directly used as an antenna terminal 1502. With this configuration, the other end of the transmitting filter 1504 is used as a transmitting terminal 1503, and the receiving terminal 1101 (see FIG. 12A) of the filter 1505 with the matching circuit is used as a receiving terminal 1503.

The operation of the duplexer configured as described above will be described below.

A transmission signal having been input to the transmitting terminal 1503 enters the transmitting filter 1504. Only the signal components thereof with frequencies within the pass band frequencies of the transmitting filter 1504 pass through, and are output from the antenna terminal 1502 via the matching circuit in the filter 1505 with the matching circuit without being affected by the band pass filter in the filter 1505 with the matching circuit. In addition, a reception signal having been input to the antenna terminal 1502 is input to the band pass filter in the filter 1505 with the matching circuit via the matching circuit in the filter 1505 with the matching circuit without being affected by the transmitting filter 1504. Only the signal components thereof with frequencies within the pass band frequencies of the band pass filter pass through, and are output to the receiving terminal 1501. This configuration thus operates as a duplexer.

As a result, the transmitting filter 2006 (see FIG. 21) is unnecessary, and the duplexer can be made far more compact.

Such a duplexer as the present embodiment may also be used for mobile communication apparatuses. In this case, the configuration of the duplexer is effective in making mobile communication apparatuses far more compact.

Although the receiving filter of the duplexer in accordance with the present embodiment can be formed by various methods, the duplexer in accordance with the present invention is not limited to details about such methods.

(EMBODIMENT 10)

Figure 17A:
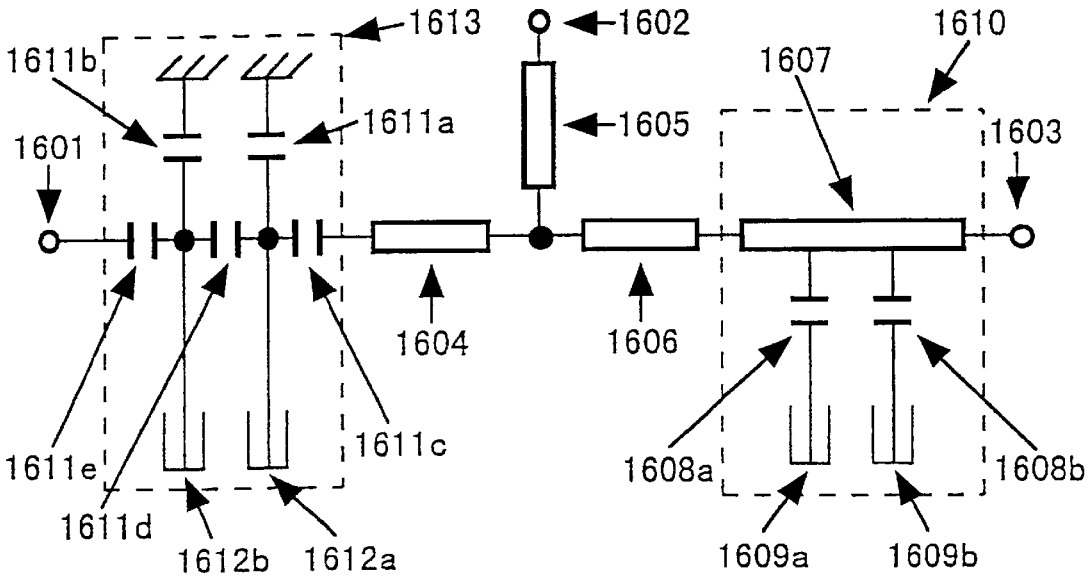
FIG. 17A is a circuit diagram of a duplexer in accordance with embodiment 10 of the present invention.

FIG. 17A is a circuit diagram of a duplexer in accordance with embodiment 10 of the present invention.

As shown in FIG. 17A, the duplexer has a main unit 1614 of an integrated shape comprising a first transmission line 1604, a second transmission line 1605, a third transmission line 1606, a transmission line 1607 for a transmitting filter, two capacitor elements 1608*a* and 608*b* for the transmitting filter, two resonators 1609*a* and 609*b* for the transmitting filter, five capacitor elements 1611*a*, 1611*b*, 1611*c*, 1611*d* and 1611*e* for a receiving filter, and two resonators 1612*a* and 1612*b* for the receiving filter. One end of the first transmission line 1604, one end of the second transmission line 1605 and one end of the third transmission line 1606 are connected to one another. In addition, the transmission line 1607 for the transmitting filter is connected to the two resonators 1609*a* and 1609*b* for the transmitting filter via the capacitor elements 1608*a* and 1608*b* for the transmitting filter, respectively. Furthermore, the other end of the third transmission line 1606 is connected to one end of the transmission line 1607 for the transmitting filter. Moreover, as described referring to FIG. 12A, the other end of the first transmission line 1604 is connected to the resonator 1612*a* for the receiving filter, the resonator 1612*a* for the receiving filter is connected to the resonator 1612*b* for the receiving filter, and the resonator 1612*b* for the receiving filter is connected to the receiving terminal 1601 via the capacitor elements 1611*c*, 1611*d* and 1611*e* for the receiving filter, respectively. Besides, the capacitor elements 1611*a* and 1611*b* for the receiving filter are connected to the open ends of the resonators 1612*a* and 1612*b* for the receiving filter, respectively, and grounded. Additionally, an antenna terminal 1602 is connected to the other end of the second transmission line 1605, and a transmitting terminal 1603 is connected to the other end of the transmission line 1606 for the transmitting filter. In this way, the circuit is configured as described above.

Figure 17B:
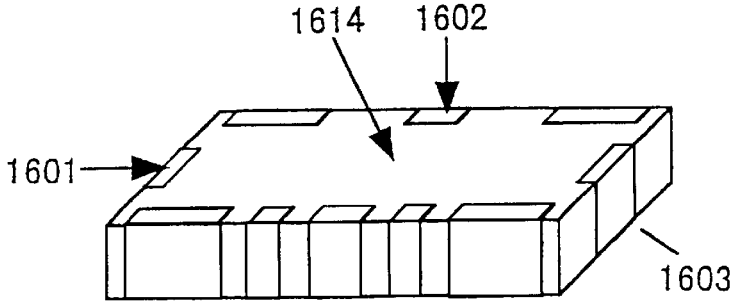
FIG. 17B is a perspective view showing the duplexer accordance with embodiment 10 of the present invention.

FIG. 17B is a perspective view showing the main unit 1614 of the duplexer in accordance with embodiment 10.

Referring to FIG. 17B, the main unit 1614 incorporates the first transmission line 1604, the second transmission line 1605, the third transmission line 1606, the transmission line 1607 for the transmitting filter, the two capacitor elements 1608*a* and 1608*b* for the transmitting filter, the two resonators 1609*a* and 1609*b* for the transmitting filter, the five capacitor elements 1611*a*, 1611*b*, 1611*c*, 1611*d* and 1611*e* for the receiving filter and the two resonators 1612*a* and 1612*a* for the receiving filter. Furthermore, the receiving terminal 1601, the antenna terminal 1602 and the transmitting terminal 1603 are provided on the side surfaces of the main unit 611.

The operation of the duplexer configured as described above will be described below.

Since the capacitor elements 1608*a* and 1608*b* for the transmitting filter connected to the transmission line 1607 for the transmitting filter are connected in series with the resonators 1609*a* and 1609*b* for the transmitting filter, respectively, they operate as two notches wherein the amount of attenuation is high at the resonance frequencies of the resonators 1609*a* and 1609*b* for the transmitting filter. Furthermore, by adjusting the connection positions of the capacitor elements 1608*a* and 1608*b* for the transmitting filter to the transmission line 1607 for the transmitting filter, the transmission line 1607 for the transmitting filter is divided into three portions: a connection element between the two notches, and two connection elements for distributed constant lines on the external sides. Therefore, there sonators 1609*a* and 1609*b* for the transmitting filter are connected in parallel with each other via the capacitor elements 1608*a* and 1608*b*, respectively, whereby the configuration operates as a notch filter 1610 wherein both ends of the transmission line 1607 for the transmitting filter are used as input and output terminals.

The capacitor elements 1611*a* and 1611*b* for the receiving filter operate as load capacitors for the resonators 1612*a* and 1612*b* for the receiving filter, respectively, and they adjust the resonance frequencies of the resonators. In addition, the capacitor element 1611*d* for the receiving filter operates as an interstage coupling capacitor between the resonator 1612*a* for the receiving filter and the resonator 1612*b* for the receiving filter, and the capacitor elements 1611*c* and 1611*e* for the receiving filter operate as input and output coupling capacitors, respectively. Therefore, this configuration operates as a band pass filter 1613 wherein the capacitor elements 1611*c* and 1611*e* are used as an input terminal and an output terminal for the receiving filter, respectively.

Furthermore, the third transmission line 1606 is set to have a line length equal to nearly one quarter wavelength in the frequency band of the band pass filter, 4nd the first transmission line 1604 is set to have a line length equal to nearly one quarter wavelength in the frequency band of the notch filter 1610. It is herein assumed that the impedance at the connection point of the first transmission line 1604 and the third transmission line 1606 is ZA7, that the impedance at the antenna terminal 1602 is ZB7, and that the characteristic impedance of the second transmission line 1605 is Z07. By using Equation 7 described below, i. e., a general equation regarding impedance matching, 50 is assigned to ZB7 so that ZB7=50 ohms is obtained in the entire frequency bands of the notch filter 1610 and the band pass filter 1613:

$$Z07 \times Z07 = ZA7 \times 50 \qquad \text{[Equation 7]}$$

the characteristic impedance Z07 and the line length of the second transmission line 1605 are set.

In this case, the second transmission line 1605 operates as an impedance converter, and converts the impedance ZA7 at the connection point of the first transmission line 1604 and the third transmission line 1606 to 50 ohms.

As a result, by adjusting the line condition of the second transmission line 1605, the impedance matching between the antenna terminal 1602 and the notch filter 1610 can be attained, and the impedance matching between the antenna terminal 1602 and the band pass filter 1610 can be attained, while the degree of freedom of design of the first transmission line 1604 and the third transmission line 1606 remains unchanged.

With the above-mentioned configuration, the present embodiment operates as a compact duplexer capable of being formed of a simple circuit. In other words, this configuration does not require the receiving filter 2006 or the transmitting filter 2007 (see FIG. 21), thereby being made far more compact. Although the notch filter 1610 is used as the transmitting filter in accordance with the present invention, a low pass filter may be used. Even in this case, the same effect can be obtained (see FIG. 7).

Next, a modification example of the above-mentioned embodiment will be described below referring to FIGS. 18A and 18B.

Figure 18A:
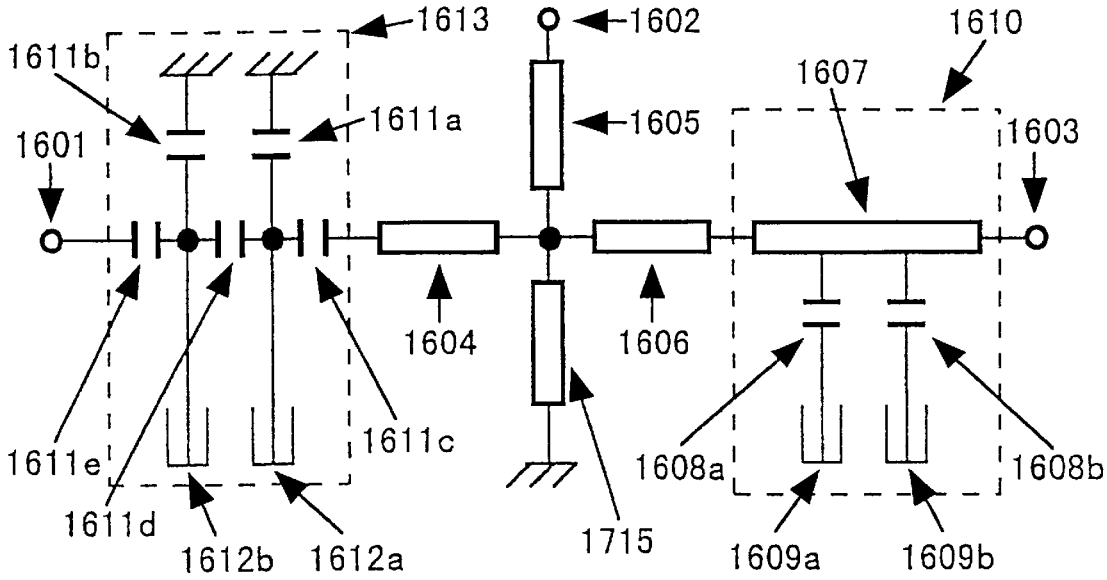
FIG. 18A is a circuit diagram of a duplexer in accordance with a modification of embodiment 10 of the present invention.
Figure 18B:
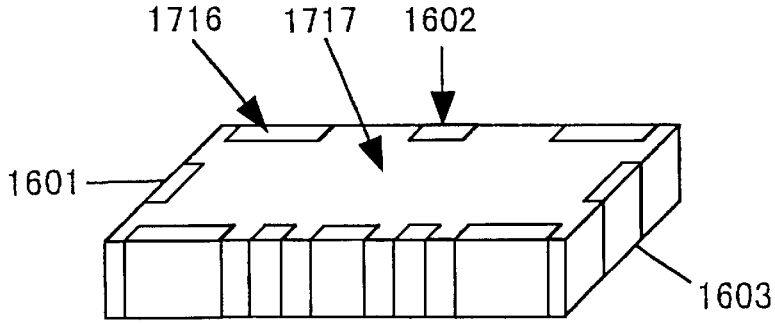
FIG. 18B is a perspective view showing the duplexer accordance with the modification of embodiment 10 of present invention.

Although the matching circuit portion of the duplexer in accordance with the above-mentioned embodiment comprises three transmission lines, it is possible to have a configuration wherein one end of a fourth transmission line 1715 is connected to the connection point of the first transmission line 1604, the second transmission line 1605 and third transmission line 1606 as shown in FIG. 18A, and the other end thereof is grounded via a ground terminal 1716 provided on a side surface of the main unit 1717 of the modification example as shown in FIG. 18B.

This configuration is effective in reducing a load to the second transmission line 1605 and in attaining impedance matching in a wide frequency range because of the same reason as that described above.

Although the transmission lines, capacitor elements and resonators in accordance with the present embodiment can be formed by various methods, the present invention is not limited to details about such methods.

(EMBODIMENT 11)

Figure 19:
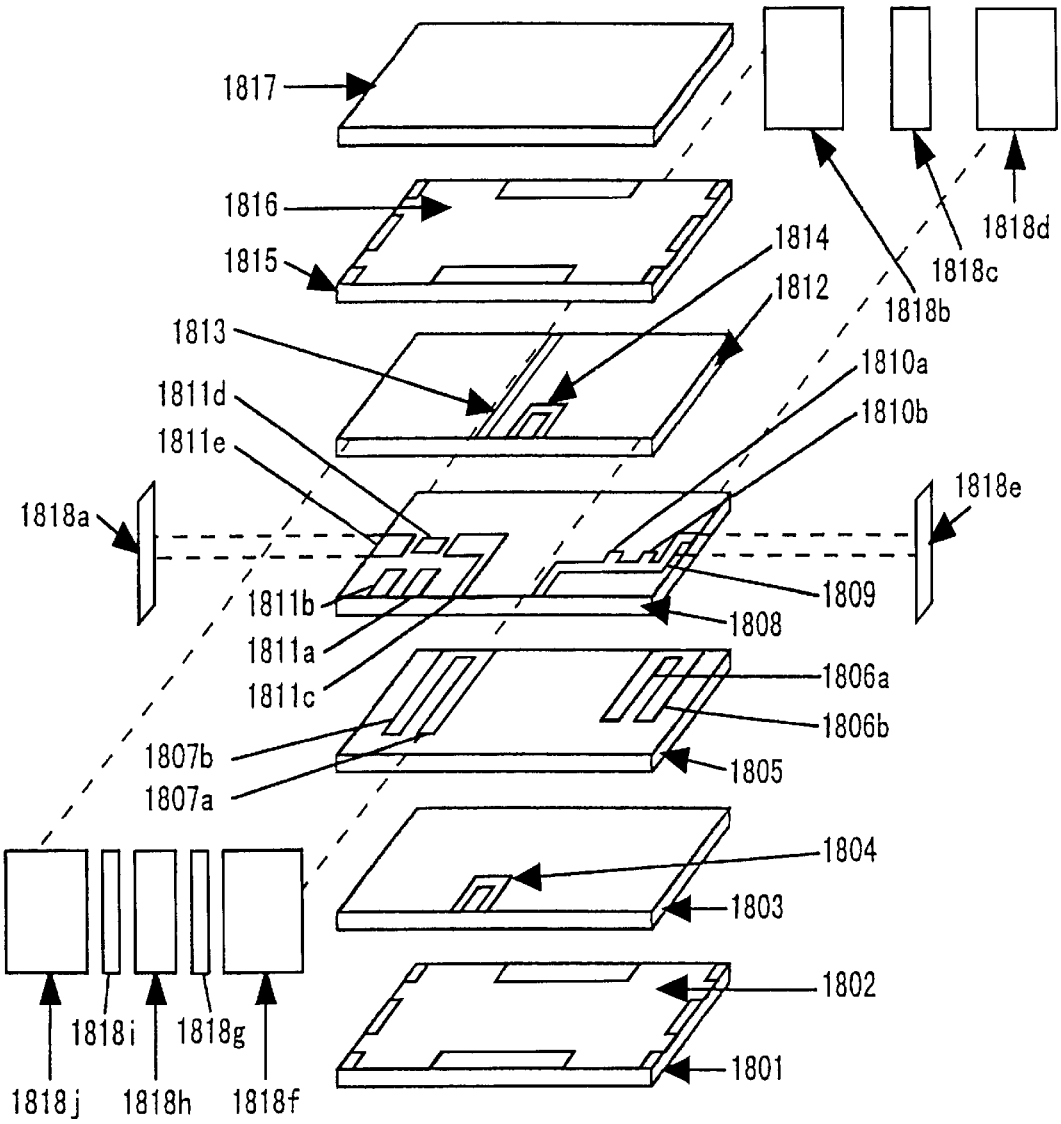
FIG. 19 is a perspective view showing a duplexer in accordance with embodiment 11 of the present invention.

FIG. 19 is a duplexer in accordance with embodiment 11 of the present invention.

As shown in FIG. 19, a first shield electrode 1802 is disposed on the upper surface of a first dielectric layer 1801, a second dielectric layer 1803 is laid (laminated) on the electrode 1802, and a first transmission line electrode 1804 is disposed on the upper surface of the dielectric layer 1803. In addition, a third dielectric layer 1805 is laid on the electrode 1804, two resonator electrodes 1806*a* and 1806*b* for a transmitting filter and two resonator electrodes 1807*a* and 1807*b* for a receiving filter are disposed on the upper surface of the dielectric layer 1805. Furthermore, a fourth dielectric layer 1808 is laid on the resonator electrodes 1807*a* and 1807*b*, and a transmission line electrode 1809 for the transmitting filter, two capacitor electrodes 1810a and 1810b for the transmitting filter and five capacitor electrodes 1811*a*, 1811*b*, 1811*c*, 1811*d* and 1811*e* for the transmitting filter are disposed on the upper surface of the dielectric layer 1808. Moreover, a fifth dielectric layer 1812 is laid on the transmission line electrode 1809, the capacitor electrodes 1810a and 1810b and the capacitor electrodes 1811*a*, 1811*b*, 1811*c*, 1811*d* and 1811*e*, a second transmission line electrode 1313 and a third transmission line electrode 1814 are disposed on the upper surface of the dielectric layer 1812. Besides, a sixth dielectric layer 1815 is laid on the transmission line electrodes 1813 and 1814, a second shield electrode 1816 is disposed on the upper surface of the dielectric layer 1815, and a seventh dielectric layer 1817 is laid on the electrode 1816. Additionally, 10 end surface electrodes 1818 are provided on the side surfaces of a dielectric comprising the dielectric layers, and the capacitor electrode 1811*e* for the receiving filter is connected to an end surface electrode 1818*a*. Furthermore, the first shield electrode 1802, the resonator electrodes 1807*a* and 1807*b* for the receiving filter, the second shield electrode 1816 and an end surface electrode 1818*b* are connected to one another and grounded. Moreover, the second transmission line electrode 1813 is connected to an end surface electrode 1818*c*. In addition, the first shield electrode 1802, the resonator electrodes 1806*a* and 1806*b* for the transmitting filter, the second shield electrode 1816 and an end surface electrode 1818*d* are connected to one another and grounded. Furthermore, the transmission line electrode 1809 for the transmitting filter is connected to an end surface electrode 1818*e*. Moreover, the first shield electrode 1802, the second shield electrode 1816 and an end surface electrode 1818*f* are connected to one another and grounded. Additionally, the transmission line electrode 1809 for the transmitting filter, the third transmission line electrode 1813 and an end surface electrode 1818*g* are connected to one another. Besides, the first transmission line electrode 1804, the second transmission line electrode 1813, the third transmission line electrode 1814 and an end surface electrode 1818*h* are connected to one another.

Additionally, the first transmission line electrode 1804, the capacitor electrode 1811*c* for the receiving filter and an end surface electrode 1818*i* are connected to one another. Furthermore, the first shield electrode 1802, the capacitor electrodes 1811*a* and 1811*b* for the receiving filter, the second shield electrode 1816 and an end surface electrode 1818*j* are connected to one another and grounded.

The operation of the duplexer configured as described above will be described below.

Since the operation of the duplexer in accordance with the present embodiment is basically the same as the duplexer described in the explanation of embodiment 10, the present embodiment is not described in detail.

Since the resonator electrodes 1806*a* and 1806*b* for the transmitting filter are grounded via the end surface electrode 1818*d,* they form a quarter wave resonator. The capacitor electrodes 1810a and 1810b for the transmitting filter connected to the transmission line electrode 1809 for the transmitting filter are disposed facing the open ends of the resonator electrodes 1806*a* and 1806*b,* respectively, to form notch capacitances, thereby operating as two notches having high attenuation amounts at the resonance frequencies of the resonators. Furthermore, by adjusting the connection position of the transmission line electrode 1809 for the transmitting filter and the capacitor electrodes 1810*a* and 1810*b* for the transmitting filter, the transmission line electrode 1809 for the transmitting filter is divided into three portions: a connection element between the two notches, and two connection elements for distributed constant lines on the external sides. Therefore, the resonator electrodes 1806*a* and 1806*b* for the transmitting filter are connected in parallel with each other via the capacitor electrodes 1810*a* and 1810*b,* respectively, whereby the configuration operates as a notch filter wherein both ends of the transmission line 1809 for the transmitting filter are used as input and output terminals.

Since the resonator electrodes 1807*a* and 1807*b* for the receiving filter are grounded at one end thereof via the end surface electrode 1818*b,* they operate as a quarter-wave resonator. Since the capacitor electrodes 1811*a* and 1811*b* for the receiving filter are displaced facing the open ends of the resonator electrodes 1807*a* and 1807*b* for the receiving filter, respectively, they operate as load capacitors and adjust the resonance frequencies of the resonators. In addition, since the capacitor electrode 1811*d* for the receiving filter is disposed facing a part of the resonator electrode 1807*a* for the receiving filter and a part of the resonator electrode 1807*b* for the receiving filter, it operates as an interstage coupling capacitor between the two resonators. Since the capacitor electrode 1811*c* for the receiving filter is disposed facing a part of the resonator electrode 1807*a* for the receiving filter, and the capacitor electrode 1811*e* for the receiving filter is disposed facing a part of the resonator electrode 1807*b* for the receiving filter, they operate as input and output coupling capacitors. Therefore, this configuration operates as a band pass filter of a capacitive coupling type wherein the capacitor electrodes 1811*c* and 1811*e* are used as an input terminal and an output terminal, respectively.

The length of the third transmission line electrode 1814 is set at nearly one quarter wavelength in the frequency band of the band pass filter comprising the resonator electrodes 1807*a* and 1807*b* for the receiving filter, the capacitor electrodes 1811*a,* 1811*b,* 1811*c,* 1811*d* and 1811*e* for the receiving filter, and the length of the first transmission line electrode 1804 is set at nearly one quarter wavelength in the frequency band of the notch filter comprising the resonator electrodes 1806*a* and 1806*b* for the transmitting filter, the transmission line electrode 1809 for the transmitting filter, the capacitor electrodes 1810*a* and 1810*b* for the transmitting filter. In addition, it is assumed that the impedance at the end surface electrode 1818*c* is Zc8, that the impedance at the end surface electrode 1818*h* is zh8, and that the characteristic impedance of the second transmission line electrode 1813 is Z08. By using Equation 8 described below, i. e., a general equation regarding impedance matching, 50 is assigned to Zc8 so that Zc8=50 ohms is obtained in the entire frequency bands of the notch filter and the band pass filter:

$$Z08 \times Z08 = Zh8 \times 50 \qquad \text{[Equation 8]}$$

the characteristic impedance Z08 and the line length of the second transmission line electrode 1813 are set.

In this case, the second transmission line electrode 1813 operates as an impedance converter, and converts the impedance Zh8 of the end surface electrode 1818*h* to 50 ohms.

As a result, by adjusting the line condition of the second transmission line electrode 1813, the impedance matching between the notch filter and the end surface electrode 1818*c* can be attained, and the impedance matching between the band pass filter and the end surface electrode 1818*c* can be attained, while the degree of freedom of design of the first transmission line electrode 1804 and the third transmission line electrode 1814 remains unchanged. This configuration thus operates as a matching circuit.

Therefore, in the present embodiment, the end surface electrode 1818*a* is used as a receiving terminal, the end surface electrode 1818*c* is used as an antenna terminal, and the end surface electrode 1818*e* is used as a transmitting terminal, whereby this configuration operates as a compact duplexer capable of being formed of a simple circuit.

The shield electrodes in accordance with the present embodiment are two layers: the first shield electrode 1802 and the second shield electrode 1816. However, the present embodiment is not limited to this configuration, and a configuration shown in FIG. 20 may be used.

Figure 20:
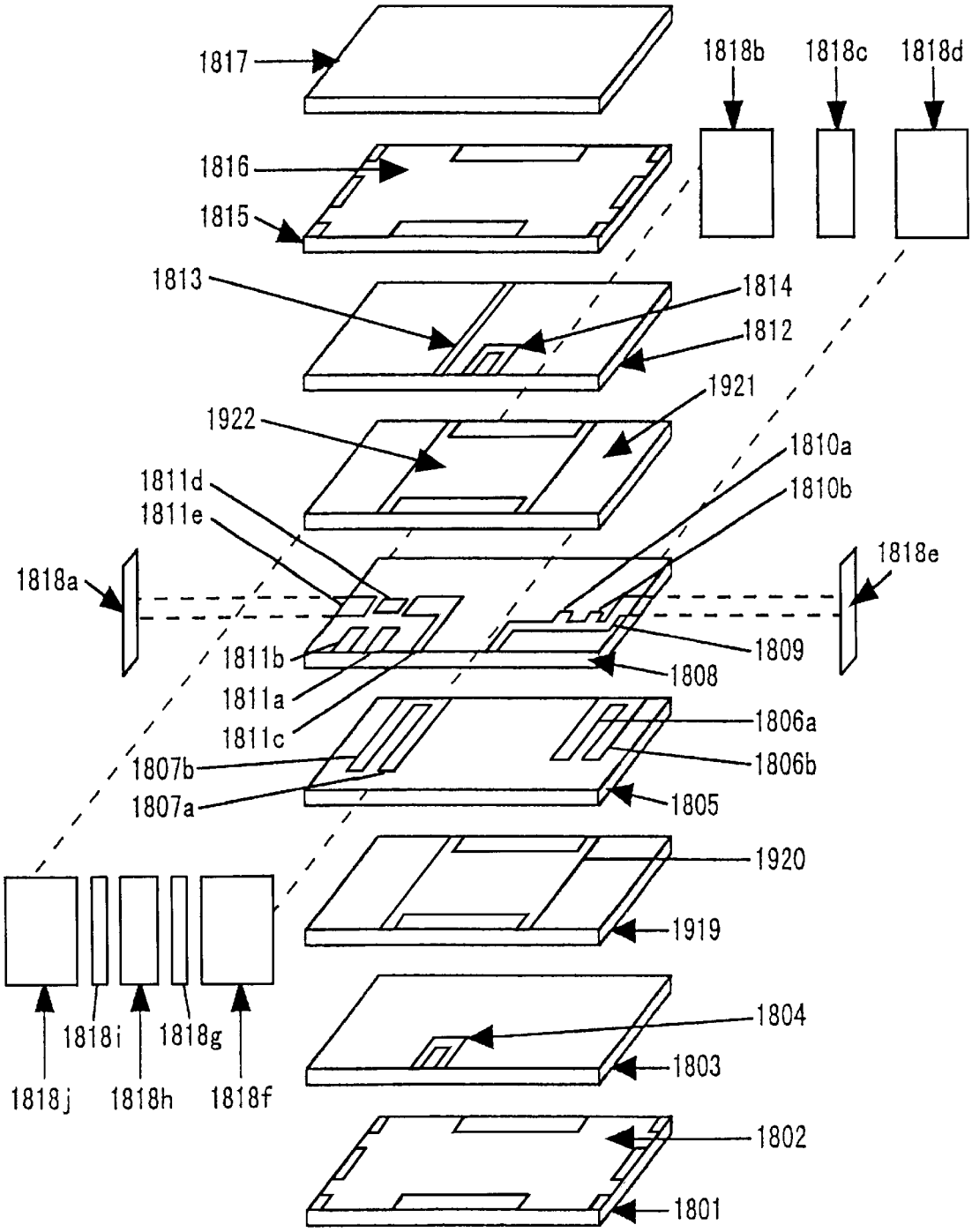
FIG. 20 is a perspective view showing another configuration of the duplexer in accordance with embodiment 11 of the present invention.

In other words, as shown in FIG. 20, an eighth dielectric layer 1919 is laid on the first transmission line electrode 1804, a third shield electrode 1920 is disposed on the upper surface of the dielectric layer 1919, and the third dielectric layer 1805 is laid on the electrode 1920. Furthermore, a ninth dielectric layer 1921 is laid on the transmission line electrode 1809 for the transmitting filter, the capacitor electrodes 1810*a* and 1810*b* for the transmitting filter and the capacitor electrodes 1811*a,* 1811*b,* 1811*c,* 1811*d* and 1811*e* for the receiving filter, a fourth shield electrode 1922 is disposed on the upper surface of the dielectric layer 1921, and the fifth dielectric layer 1812 is laid on the electrode 1922.

In this case, the first transmission line electrode 1804 is separated from the resonator electrodes 1806*a* and 1806*b* for the transmitting filter, the resonator electrodes 1807*a* and 1807*b* for the receiving filter, the transmission line electrode 1809 for the transmitting filter, the capacitor electrodes 1810*a* and 1810*b* for the transmitting filter and the capacitor electrodes 1811*a,* 1811*b,* 1811*c,* 1811*d* and 1811*e* for the transmitting filter by the third shield electrode 1920. Furthermore, the resonator electrodes 1806*a* and 1806*b* for the transmitting filter, the resonator electrodes 1807*a* and 1807*b* for the receiving filter, the transmission line electrode 1809 for the transmitting filter, the capacitor electrodes 1810*a* and 1810*b* for the transmitting filter, the capacitor electrodes 1811*a,* 1811*b,* 1811*c,* 1811*d* and 1811*e* for the receiving filter are separated from the second transmission line electrode 1813 and the third transmission line electrode

1814 by the fourth shield electrode 1922. Therefore, electromagnetic coupling among the three sets of electrodes is eliminated, thereby being effective in accurately achieving a duplexer.

In addition, the third shield electrode 1920 and the fourth shield electrode 1922 each have a size for covering only the matching circuit portion in order to maintain the characteristic impedances of the resonators high. However, the size may be the same as those of the first shield electrode 1802 and the second shield electrode 1816. In this case, unnecessary electromagnetic coupling among the three sets of electrodes is more eliminated, thereby being effective in accurately achieving a resonator.

In addition, a capacitive electrode may be provided in the dielectric layers of the present embodiment, and connected to the end surface electrode 1818*e,* for example, to form a capacitor between the end surface electrode 1818*e* and the ground. This configuration is effective in easily attaining impedance matching for the notch filter. Furthermore, the capacitive electrode may be connected to the end surface electrode 1818*g* or both. This configuration is also effective in attaining impedance matching easily.

Additionally, a capacitive electrode may be provided in the dielectric layers of the present embodiment, and connected to the end surface electrode 1818*a,* for example, to form a capacitor between the end surface electrode 1818*a* and the ground. This configuration is effective in easily attaining impedance matching of the band pass filter. Furthermore, the capacitive electrode may be connected to the end surface electrode 1818*i* or both. This configuration is also effective in attaining impedance matching easily.

In addition, a capacitive electrode may be provided in the dielectric layers of the present embodiment, and connected to the end surface electrode 1818*h,* for example, to form a capacitor between the end surface electrode 1818*h* and the ground. This configuration is effective in more easily attaining impedance matching of the matching filter. Furthermore, the end surface electrode 1818*c,* the end surface electrode 1818*g* or the end surface electrode 1818*i* may be connected to the capacitive electrode, or plural end surface electrodes may be connected thereto. This configuration is also effective in easily attaining impedance matching.

Moreover, a short stub line electrode may be provided in the dielectric layers of the present embodiment, and connected to the end surface electrode 1818*g,* for example, to form a half-wave stub line. In this case, by adjusting the length of the line, an attenuation pole is formed in the harmonic band of the notch filter, thereby being effective in increasing the amount of attenuation. Besides, the end surface electrode 1818*c,* the end surface electrode 1818*e* or the end surface electrode 1818*h* may be connected to the short stub line electrode, or plural end surface electrodes may be connected thereto. In this case, an attenuation pole is also formed in the harmonic band of the notch filter, thereby being effective in increasing the amount of attenuation.

Additionally, the short stub line electrode may be used as an open stub electrode. In this case, the stub line electrode becomes a quarter-wave stub line and offers a similar action, thereby being effective in reducing the area of the electrode.

Furthermore, when an attenuation pole is formed in the harmonic band by using the stub line, the attenuation pole acts as a capacitance near the pass band of the notch filter, thereby being effective in easily attaining impedance matching.

Moreover, a short stub line electrode may be provided in the dielectric layers of the present embodiment, and connected to the end surface electrode 1818*i,* for example, to form a half-wave stub line. In this case, by adjusting the length of the line, an attenuation pole is formed in the harmonic band of the band pass filter, thereby being effective in increasing the amount of attenuation. Besides, the end surface electrode 1818*a,* the end surface electrode 1818*c* or the end surface electrode 1818*h* may be connected to the short stub line electrode, or plural end surface electrodes may be connected thereto. In this case, an attenuation pole is also formed in the harmonic band of the band pass filter, thereby being effective in increasing the amount of attenuation.

Additionally, the short stub line electrode may be used as an open stub electrode. In this case, the stub line electrode becomes a quarter-wave stub line and offers a similar action, thereby being effective in reducing the area of the electrode.

Furthermore, when an attenuation pole is formed in the harmonic band by using the stub line, the attenuation pole acts as a capacitance near the pass band of the band pass filter, thereby being effective in easily attaining impedance matching.

Moreover, although the electrodes in accordance with the present embodiment are connected to one another via the end surface electrodes provided on the side surfaces of a dielectric comprising the dielectric layers, the electrodes may be connected by using through holes formed in the dielectric. This configuration is effective in reducing external effects.

The configuration in accordance with the above-mentioned embodiment can be applied to duplexers used for high-frequency apparatuses, such as cellular phones. With this configuration, it is possible to obtain a matching chip of a compact integration type having a simple configuration which can easily attain impedance matching while the degree of freedom of design of the transmission lines is maintained.

Although the transmission lines in accordance with the present embodiment can be formed by various methods, the present invention is not limited to details about such methods.

Furthermore, although various materials can be used for electrode materials and dielectric materials in accordance with the present embodiment, the present invention is not limited to those materials.

What is claimed is:

1. A duplexer having a configuration wherein a first shield electrode is disposed on the upper surface of a first dielectric layer, a second dielectric layer is laid (laminated) on said first shield electrode, a first transmission line electrode is disposed on the upper surface of said second dielectric layer, a third dielectric layer is laid on said first transmission line electrode, a plurality of resonator electrodes for a transmitting filter and a plurality of resonator electrodes for a receiving filter are disposed on the upper surface of said third dielectric layer, a fourth dielectric layer is laid on said plural resonator electrodes for said transmitting filter and plural resonator electrodes for said receiving filter, a transmission line electrode for said transmitting filter, a plurality of capacitor electrodes for said transmitting filter and a plurality of capacitor electrodes for said receiving filter are disposed on the upper surface of said fourth dielectric layer, a fifth dielectric layer is laid on said transmission line electrode for said transmitting filter, said plural capacitor electrodes for said transmitting filter and said plural capacitor electrodes for said receiving filter, a second transmission line electrode and a third transmission line electrode are disposed on the upper surface of said fifth dielectric layer, a sixth dielectric layer is laid on said second transmission line electrode and said third transmission line electrode, a second shield electrode is disposed on the upper surface of said sixth dielectric layer, a seventh dielectric layer is laid on said second shield electrode, and at least four end surface electrodes are disposed on the side surfaces of a dielectric comprising said stacked dielectric layers, wherein one end of said first transmission line electrode, one end of said second transmission line electrode and one end of said third transmission line electrode are electrically connected to one another, the other end of said third transmission line electrode is electrically connected to one end of said transmission line electrode for said transmitting filter, said capacitor electrodes for said transmitting filter are disposed so as to be laid over parts of said resonator electrodes for said transmitting filter arranged in parallel, respectively, said capacitor electrodes for said transmitting filter are connected to said transmission line electrode for said transmitting filter, said end surface electrodes connected to the other end of said transmission line electrode for said transmitting filter is used as a transmitting terminal, said resonator electrodes for said receiving filter are disposed in parallel, said capacitor electrodes for said receiving filter are disposed so that parts thereof are laid over both of said resonator electrodes for said receiving filter adjacent to each other, said capacitor electrode for said receiving filter disposed so as to be laid over a part of said resonator electrode for said receiving filter disposed at one end of the arrangement of said plural resonator electrodes for said receiving filter is electrically connected to the other end of said first transmission line, said at least for end surface electrode connected to said capacitor electrode for said receiving filter disposed so as to be laid over a part of said resonator electrode for said receiving filter disposed at the other end of the arrangement of said plural resonator electrodes for said receiving filter is used as a receiving terminal. A third of said at least for end surface electrode connected to the other end of said second transmission line electrode is used as an antenna terminal, and said end surface electrodes connected to said first shield electrode and said second shield electrode are grounded.

2. A duplexer in accordance with claim 1, wherein at least one of said plurality of capacitive electrodes is disposed in said dielectric layers and connected to one of said end surface electrodes.

3. A duplexer in accordance with claim 1, wherein at least one stub line is disposed in at least one of each of said dielectric layers, and said stub line is connected to said antenna terminal, said transmitting terminal, the connection point of said first transmission line electrode, said second transmission line electrode and said third transmission line electrode or the connection point of said third transmission line electrode and said transmission line electrode for said transmitting filter.

4. A duplexer in accordance with claim 1, wherein at least one stub line is disposed in at least one of each of said dielectric layers, and said stub line is connected to said antenna terminal, said receiving terminal, the connection point of said first transmission line electrode, said second transmission line electrode and said third transmission line electrode or the connection point of said first transmission line electrode and said capacitor electrode for said receiving filter.

5. A duplexer having a configuration wherein a first shield electrode is disposed on the upper surface of a first dielectric layer, a second dielectric layer is laid (laminated) on said first shield electrode, a first transmission line electrode is disposed on the upper surface of said second dielectric layer, an eighth dielectric layer is laid on said first transmission line electrode, a third shield electrode is disposed on the upper surface of said eighth dielectric layer, a third dielectric layer is laid on said third shield electrode, a plurality of resonator electrodes for a transmitting filter and a plurality of resonator electrodes for a receiving filter are disposed on the upper surface of said third dielectric layer, a fourth dielectric layer is laid on said plural resonator electrodes for said transmitting filter and plural resonator electrodes for said receiving filter, a transmission line electrode for said transmitting filter, a plurality of capacitor electrodes for said transmitting filter and a plurality of capacitor electrodes for said receiving filter are disposed on the upper surface of said fourth dielectric layer, a ninth dielectric layer is laid on said transmission line electrode for said transmitting filter, said plural capacitor electrodes for said transmitting filter and said plural capacitor electrodes for said receiving filter, a fourth shield electrode is disposed on the upper surface of said ninth dielectric layer, a fifth dielectric layer is laid on said fourth shield electrode, a second transmission line electrode and a third transmission line electrode are disposed on the upper surface of said fifth dielectric layer, a sixth dielectric layer is laid on said second transmission line electrode and said third transmission line electrode, a second shield electrode is disposed on the upper surface of said sixth dielectric layer, a seventh dielectric layer is laid on said second shield electrode, and at least four end surface electrodes are disposed on the side surfaces of a dielectric comprising said stacked dielectric layers, wherein one end of said first transmission line electrode, one end of said second transmission line electrode and one end of said third transmission line electrode are electrically connected to one another, the other end of said third transmission line electrode is electrically connected to one end of said transmission line electrode for said transmitting filter, said capacitor electrodes for said transmitting filter are disposed so as to be laid over parts of said resonator electrodes for said transmitting filter arranged in parallel, respectively, said capacitor electrodes for said transmitting filter are connected to said transmission line electrode for said transmitting filter, a first of said at least four end surface electrode connected to the other end of said transmission line electrode for said transmitting filter is used as a transmitting terminal, said resonator electrodes for said receiving filter are disposed in parallel, said capacitor electrodes for said receiving filter are disposed so that parts thereof are laid over both of said resonator electrodes for said receiving filter adjacent to each other, said capacitor electrode for said receiving filter disposed so as to be laid over a part of said resonator electrode for said receiving filter disposed at one end of the arrangement of said plural resonator electrodes for said receiving filter is electrically connected to the other end of said first transmission line, said end surface electrodes connected to said capacitor electrode for said receiving filter disposed so as to be laid over a part of said resonator electrode for said receiving filter disposed at the other end of the arrangement of said plural resonator electrodes for said receiving filter is used as a receiving terminal, a third of said at least four end surface electrodes connected to the other end of said second transmission line electrode is used as an antenna terminal, and said end surface electrodes connected to said first shield electrode, said second shield electrode, said third shield electrode and said fourth shield electrode are grounded.

* * * * *